US009840089B2

(12) United States Patent
Ihara

(10) Patent No.: US 9,840,089 B2
(45) Date of Patent: Dec. 12, 2017

(54) PRINTER, PRINTING SYSTEM, AND CARD MANUFACTURING METHOD

(71) Applicant: JVC KENWOOD CORPORATION, Yokohama-shi, Kanagawa (JP)

(72) Inventor: Keiji Ihara, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 0 days.

(21) Appl. No.: 15/199,680

(22) Filed: Jun. 30, 2016

(65) Prior Publication Data

US 2017/0008302 A1 Jan. 12, 2017

(30) Foreign Application Priority Data

Jul. 8, 2015 (JP) ..... 2015-136660

(51) Int. Cl.
*B41J 2/36* (2006.01)
*B41J 2/325* (2006.01)
*B41J 2/32* (2006.01)

(52) U.S. Cl.
CPC ..... *B41J 2/36* (2013.01); *B41J 2/325* (2013.01); *B41J 2/32* (2013.01)

(58) Field of Classification Search
CPC ..... B41J 2/36; B41J 2/325; B41J 2/32
See application file for complete search history.

(56) References Cited

U.S. PATENT DOCUMENTS

2012/0056937 A1* 3/2012 Kagata ..... B41J 2/2107 347/43
2012/0229820 A1* 9/2012 Koyatsu ..... G06F 3/1205 358/1.1
2013/0278952 A1* 10/2013 Suzuki ..... G06K 15/02 358/1.9

FOREIGN PATENT DOCUMENTS

JP 3373714 B2 2/2003
JP 4337582 B2 9/2009

* cited by examiner

*Primary Examiner* — Lisa M Solomon
(74) *Attorney, Agent, or Firm* — Nath, Goldberg & Meyer; Jerald L. Meyer; Stanley N. Protigal

(57) ABSTRACT

An input unit receives first image data corresponding to a first print image of a first ink. A density acquisition unit acquires a density value of each pixel included in the first image data. A glossy image density decision unit sets a gloss density value to the minimum possible value of the gloss density value when the density value of the pixel is less than a predetermined value, and sets the gloss density value to a value larger than the minimum possible value when the density value of the pixel is equal to or greater than the predetermined value. A dithering processor performs dithering based on the set gloss density value to create second image data corresponding to a second print image of a second glossy ink. A transfer device transfers the first and second print images on a print body to form a glossy image on the print body.

11 Claims, 17 Drawing Sheets

| | |
|---|---|
| R VALUE | 8bit |
| G VALUE | 8bit |
| B VALUE | 8bit |

PIXEL Qa

| | |
|---|---|
| R VALUE | 48 |
| G VALUE | 72 |
| B VALUE | 96 |

FIG. 10

PIXEL Qb

| | |
|---|---|
| R VALUE | 250 |
| G VALUE | 230 |
| B VALUE | 240 |

FIG. 11

| | |
|---|---|
| R VALUE | 8bit |
| G VALUE | 8bit |
| B VALUE | 8bit |
| S VALUE | 1bit |

PRINTER, PRINTING SYSTEM, AND CARD MANUFACTURING METHOD

CROSS REFERENCE TO RELATED APPLICATION

This application is based upon and claims the benefit of priority under 35 U.S.C. §119 from Japanese Patent Application No. 2015-136660, filed on Jul. 8, 2015, the entire contents of which are incorporated herein by reference.

BACKGROUND

The present disclosure relates to a printer and printing system which print a glossy color image on a print matter using metal ink, and a method of manufacturing a card including a glossy color image printed using metal ink.

As such a printer, a retransfer device is widely used which sublimates or fuses ink of an ink ribbon with a thermal head, and transfers the ink to form an image on a transfer body. The printer again transfers and prints the image transferred to the transfer body onto a recording medium such as a card. Japanese Patent No. 4337582 describes such a retransfer device.

In the retransfer device, the ink ribbon includes ink layers of four colors, including: yellow (Y), magenta (N), cyan (c), and black (B), for example. The ink of each ink layer is sequentially transferred and superimposed on the transfer body to form a non-glossy color image. The formed image is again transferred on another transfer body for printing, so that the non-glossy color image is formed on the transfer body.

The ink ribbon can be an ink ribbon including an ink layer of metal ink showing metallic gloss instead of the black ink layer, or in some cases as an ink layer of the fifth color. The metal ink is frequently referred to as silver ink. There is a used technique to form a glossy color image on the surface of the transfer body, such as a card, by performing similar transfer and retransfer printing using an ink ribbon having an ink layer of metal ink.

The technique to form a glossy color image is described in Japanese Patent No. 3373714.

Hereinafter, such non-glossy and glossy color images formed on a transfer body are referred to as formed images. The object on which an image is to be formed by transfer printing is referred to as a transfer body.

SUMMARY

Y, M, and C color inks (hereinafter referred to as color inks) of the ink ribbon are sublimation inks that transmits light.

The sublimation ink is suitable for forming a color image of high resolution. By using the sublimation ink, the lightness and darkness of an image are controlled without reducing the number of dots of the image, so that transfer of multiple shades of color can be implemented.

On the other hand, the metal ink is light-blocking fusion ink that contains metal flakes of aluminum or the like to provide a glossy appearance.

The lightness and darkness of metal ink cannot be controlled without reducing the number of dots of the image. Metal ink basically provides only two shades, whether the ink is transferred or not.

In order to form a natural image with gloss visually recognized according to the shades of color inks, the following method is examined: data of a raw image to be transferred is subjected to dithering into glossy image data, and metal ink of the ink ribbon is transferred to the transfer body according to the glossy image data.

The glossy appearance in the formed image is obtained by metal ink of the formed image that (approximately) specularly reflects light from a light source with a high directivity.

When the transfer body to which an image is to be retransferred transmits light, metal ink is placed closest to the transfer body, and each color ink is superimposed on the metal ink.

With the aforementioned configuration, light incident on the part on which the metal ink is transferred (the metal ink transferred part) is (approximately) regularly reflected on the metal ink which is placed at the deepest position. The reflected light exits through the color inks superimposed on the metal ink. When seen in the outgoing direction of the reflected light, the metal ink transferred part is seen in a glossy color corresponding to the color inks, through which the reflected light is transmitted.

The light incident on the part on which no metal ink is transferred (the metal ink non-transferred part) reaches the material surface of the transfer body, and is diffusely reflected.

Therefore, when the density of the formed image by color inks in the metal ink transferred part is the same as that in the metal ink non-transferred part, the brightness and darkness of the formed image looks different depending on the angle of sight, with respect to the transfer body. To be specific, at a certain angle of sight, light reflected on the metal ink is seen, and the metal ink transferred part looks brighter in the metal ink transferred part than in the metal ink non-transferred part. At another angle of sight, the light reflected on the metal ink is not seen, and the metal ink transferred part looks darker.

That is, the metal ink transferred part has a difference in gloss depending on the angle of sight when it looks brighter and when it looks darker than the metal ink non-transferred part.

The difference in gloss is as follows when dithering is performed for the raw image data, so that the density of an image formed with metal ink is proportional to that of an image formed by color ink, for example.

The difference in gloss in the metal ink transferred part can be recognized, but is comparatively less noticeable in a low lightness region (a high density region) of the formed image.

In a high lightness region (a low density region), the colors of color ink are than and bright, and the metal ink transferred part is scattered in the form of dots due to the dithering.

Accordingly, in the high lightness region of the formed image, scattered dark-looking dots of the metal ink transferred part are dominantly recognized in the bright region depending on the angle of sight, so that the formed image has poor quality. There is a demand for improving this problem.

A first aspect of the embodiments provides a printer including: an input unit configured to receive first image data corresponding to a first print image of a first ink; a density acquisition unit configured to acquire a density value of each pixel included in the first image data; a glossy image density decision unit configured to set a gloss density value which specifies the density of gloss to be added to the pixel to the minimum possible value of the gloss density value, when the density value of the pixel is less than a predetermined value, and sets the gloss density value to a value larger than the minimum possible value, when the density value of the pixel is equal to or greater than the predetermined value; a dithering processor configured to perform dithering based on the set gloss density value to create second image data corresponding to a second print image of a second glossy ink; and a printing unit configured to superimpose and print the first and second print images on a print body to form a glossy image on the print body.

A second aspect of the embodiments provides a printing system including: a printer; and a printer driver configured to send image data to the printer, wherein the printer driver includes: an input unit configured to receive first image data corresponding to a first print image of a first ink; a density acquisition unit configured to acquire a density value of each pixel included in the first image data; a glossy image density decision unit configured to set a gloss density value which specifies the density of gloss to be added to the pixel to the minimum possible value of the gloss density value, when the density value of the pixel is less than a predetermined value, and to set the gloss density value to a value larger than the minimum possible value, when the density value of the pixel is equal to or greater than the predetermined value; and a dithering processor configured to perform dithering based on the set gloss density value to create second image data corresponding to a second print image of a second glossy ink; and the printer includes a printing unit configured to superimpose and print the first and second print images on a print body to form a glossy image on the print body.

A third aspect of the embodiments provides a method of manufacturing a card, including: acquiring a density value of each pixel included in first image data corresponding to a first print image of a first ink; setting a gloss density value which specifies the density of gloss to be added to the pixel to the minimum possible value of the gloss density value, when the density value of the pixel is less than a predetermined value; setting the gloss density value to a value, larger than the minimum possible value, when the density value of the pixel is equal to or greater than the predetermined value; performing dithering based on the set gloss density value to create second image data corresponding to a second print image of a second glossy ink; and superimposing and printing the first and second print images on a card to manufacture a card with a glossy image printed thereon.

BRIEF DESCRIPTION OF THE DRAWINGS

FIG. 10 is a diagram illustrating R, G, and B values of a pixel Qb.

FIG. 11 is a diagram illustrating the data structure of each pixel in color image data SN1 and glossy image data SN2.

DETAILED DESCRIPTION

First, a description is given of a printer PR as Example 1 of a printer of an embodiment according to the present invention with reference to FIGS. 1 to 21.

Example 1

The printer PR of Example 1 is a retransfer printer, a so-called card printer, for example.

Figure 1:
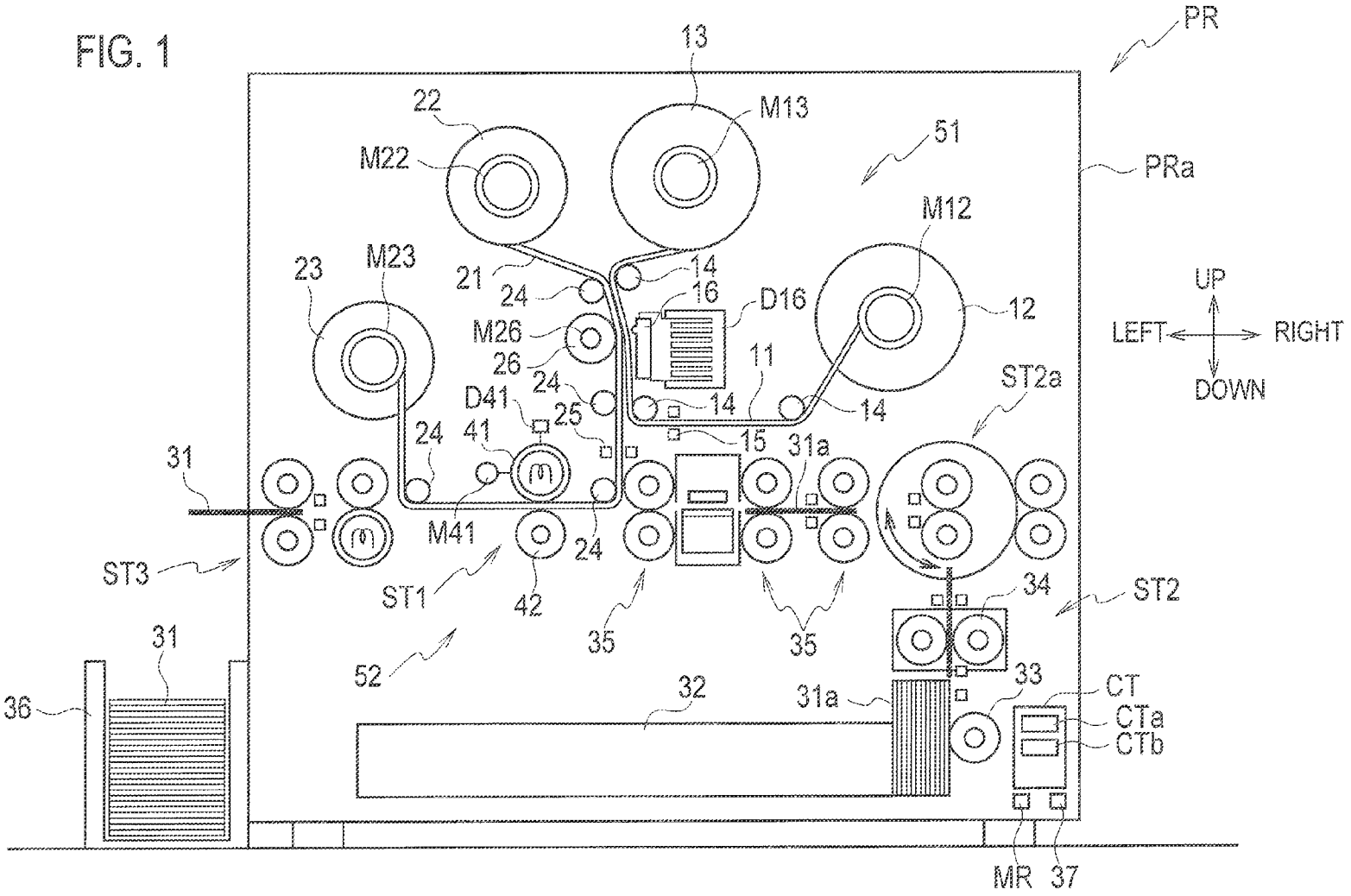
FIG. 1 is a diagram illustrating a printer PR as Example 1 of a printer according to at least one embodiment.

As illustrated in FIG. 1, the printer PR includes a casing PRa, a transfer device 51, and a retransfer device 52. The transfer and retransfer devices 51 and 52 are accommodated in the casing PRa. The transfer and retransfer devices 51 and 52 constitute a printing unit.

The printer PR transfers ink of the ink ribbon 11 to an intermediate transfer film 21 as a transfer body (a printed matter) to form an image in the transfer device 51. The printer PR further retransfers the image transferred and formed on the intermediate transfer film 21 to a card material 31*a* as another transfer body, thus producing a card 31 with the image printed thereon.

The transfer device 51 is provided with a supply reel 12 and a take-up reel 13 for the ink ribbon 11, which are detachably attached to the transfer device 51.

The attached supply and take-up reels 12 and 13 are driven and rotated by driving motors M12 and M13, respectively. The rotation speeds and directions of the motors M12 and M13 are controlled by a controller CT, which is provided for the printer PR.

The ink ribbon 11 is guided by the plural guide shafts 14, and is laid along a predetermined travel path between the supply and take-up reels 12 and 13.

In the middle of the travel path of the ink ribbon 11, an ink ribbon sensor 15 for cueing is provided.

The ink ribbon sensor 15 detects a cue mark 11*d* (refer to FIG. 3) of the ink ribbon 11, and sends ribbon mark detection information J1 (refer to FIG. 2) to the controller CT.

Figure 3:
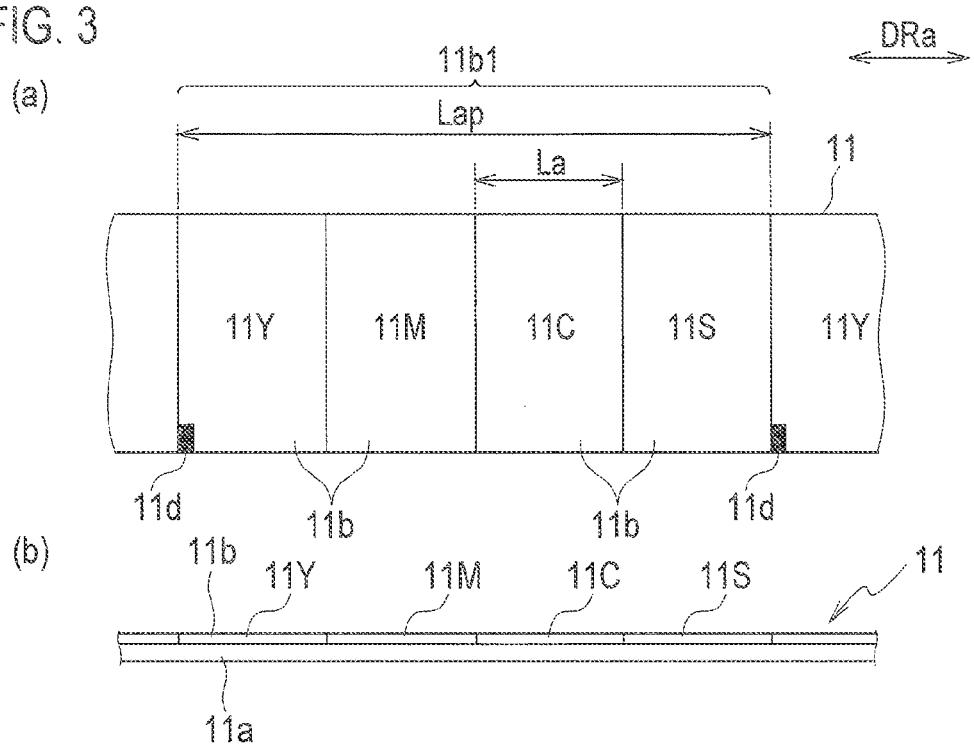
FIG. 3 is a plan view and a side view illustrating an ink ribbon 11 used in the printer PR.

As illustrated in FIG. 3, the ink ribbon 11 includes a ribbon base 11*a*, an ink layer 11Y of yellow ink, an ink layer 11M of magenta ink, an ink layer 11C of cyan ink, and an ink layer 11S metal ink providing metallic gloss. The ink layers 11Y, 11M, 11C, and 11S are formed on one surface of the ribbon base 11*a*. The ink ribbon 11 is described in detail later. In the following description, each of the yellow, magenta, and cyan inks is referred to as a color ink.

In FIG. 1, between the ink ribbon sensor 15 and the take-up reel 13 on the travel path of the ink ribbon 11, a thermal head 16 is provided.

Figure 5:
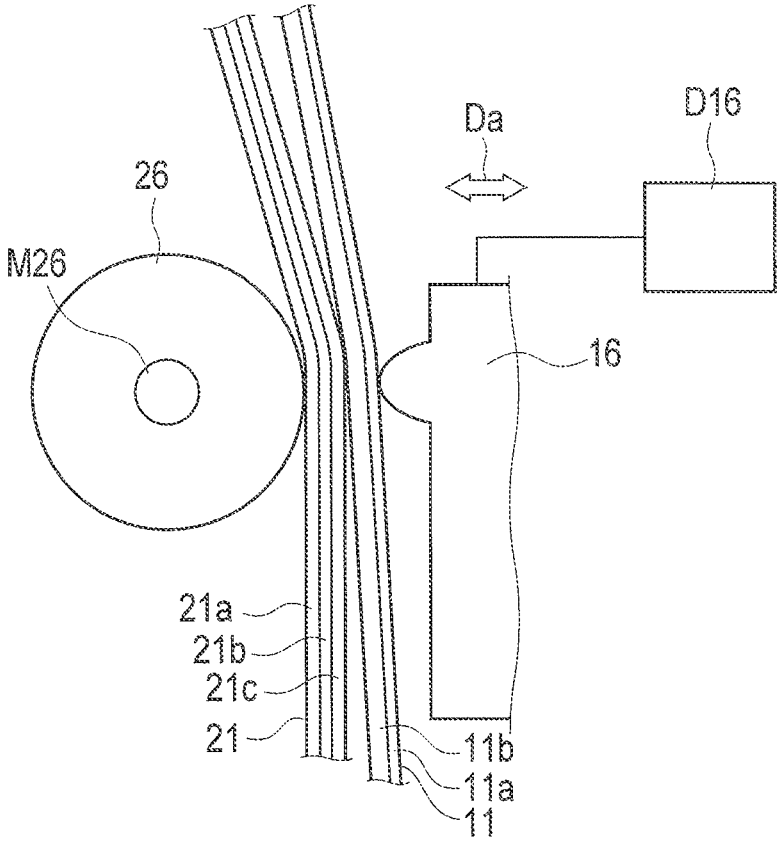
FIG. 5 is a view illustrating a pressure contact between the ink ribbon 11 and intermediate transfer film 21 by a thermal head 16 of the printer PR.

The thermal head 16 contacts and separates from the surface (refer to FIG. 3B) of the laid ink ribbon 11 on the ribbon base 11*a* side (in the direction of arrow Da of FIG. 5).

The contacting and separating operation of the thermal head 16 is executed by a head contact and separation driver D16, under control of the controller CT.

The transfer device 51 is provided with a supply reel 22 and a take-up reel 23 for the intermediate transfer film 21, which are detachably attached to the left of the loaded ink ribbon 11 in FIG. 1.

The attached supply and take-up reels 22 and 23 are driven and rotated by the driving motors M22 and M23, respectively. The rotation speeds and directions of the motors M22 and M23 are controlled by the controller CT.

The intermediate transfer film 21 is guided by the plural guide shafts 24, and is laid along a predetermined travel path between the supply and take-up reels 22 and 23.

In the middle of the travel path of the intermediate transfer film 21, a frame mark sensor 25 for cueing is provided. The frame mark sensor 25 detects frame marks 21*d* (refer to FIG. 4) of the intermediate transfer film 21, and sends frame mark detection information J2 (refer to FIG. 2) to the controller CT.

The intermediate transfer film 21 transmits light. The frame mark sensor 25 is an optical sensor, for example. The frame marks 21*d* are formed so as to block light, and the frame mark sensor 25 detects the frame marks 21*d* based on the difference between light being transmitted and light being blocked.

Between the frame mark sensor 25 and supply reel 22 on the travel path of the intermediate transfer film 21, a platen roller 26, which is driven and rotated by a motor M26, is provided. The rotation speed and direction of the motor M26 are controlled by the controller CT.

As illustrated in FIG. 5, the thermal head 16 contacts and separates from the ink ribbon 11 through the contacting and separating operation by the head contact and separation driver D16. The thermal head 16 and platen roller 26 need to relatively contact and separate from each other. The platen roller 26 may be configured to contact and separate from the ink ribbon 11.

To be specific, the thermal head 16 moves between a pressure contact position (which is illustrated in FIG. 5) and a separation position (which is illustrated in FIG. 1). When being at the pressure contact position, the thermal head 16 presses the ink ribbon 11 against the platen roller 26, to bring the intermediate transfer film 21 and ink ribbon 11 into a pressure contact between the thermal head 16 and platen roller 26. When being at the separation position, the thermal head 16 is separated from the ink ribbon 11. A later-described transfer is performed while the thermal head 16 is located at the pressure contact position.

The ink ribbon 11 and intermediate transfer film 21 are configured to be independently rewound by the take-up reels 13 and 23, and rewound by supply reels 12 and 22 through operations of the motors M12 and M13, and motors M22 and M23, respectively, while the thermal head 16 is located at the separation position.

The ink ribbon 11 and the intermediate transfer film 21, being in close contact with each other, move together toward the supply reels 13 and 23, or the take-up reels 12 and 22. The movement is executed by rotation of the supply reels 12 and 22, the take-up reels 13 and 23, and the platen roller 26 which are driven by the motors M12, M13, M22, M23, and M26 under control of the controller CT.

Figure 2:
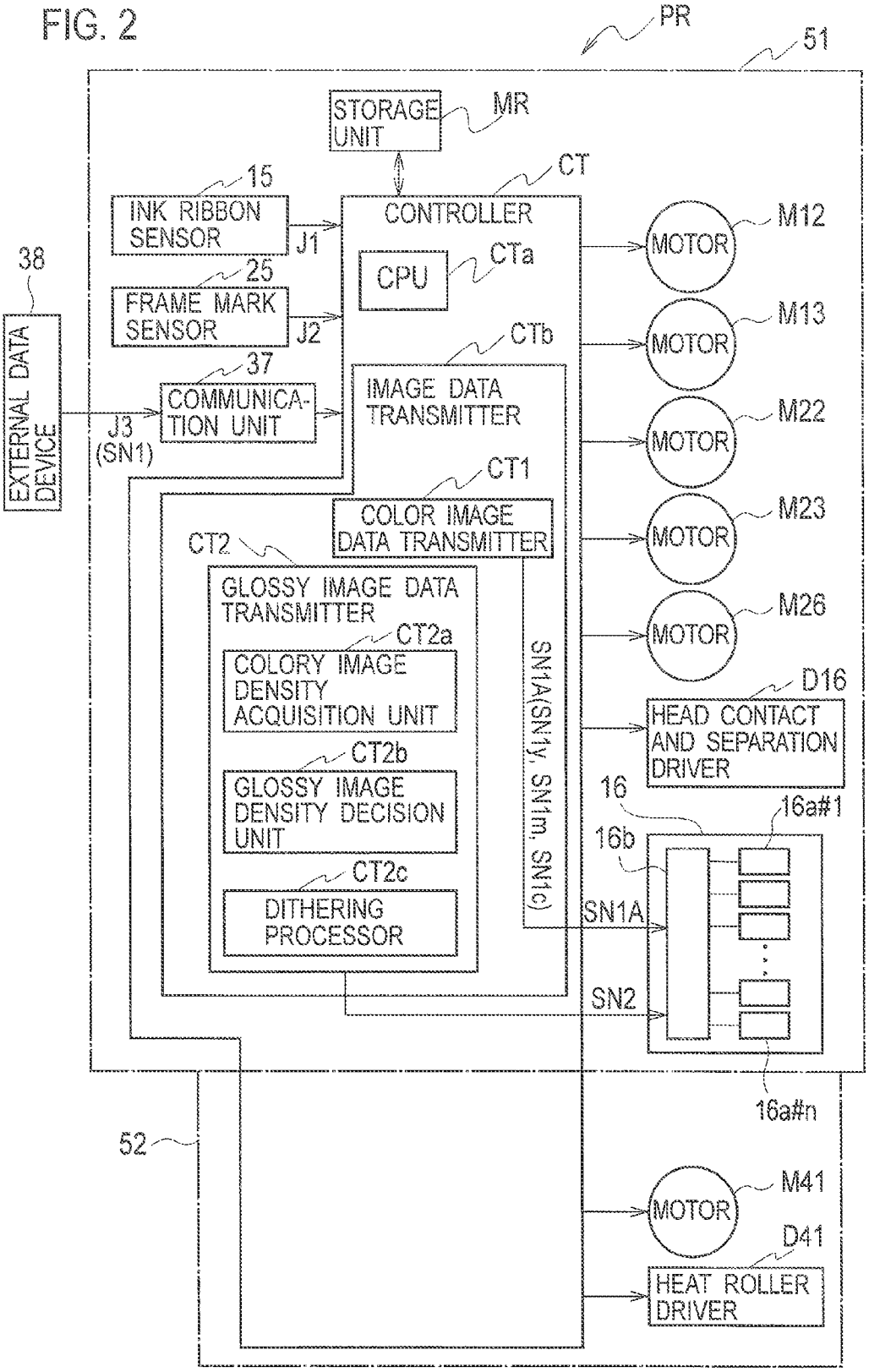
FIG. 2 is a block diagram illustrating the configuration of the printer PR.

As illustrated in FIGS. 1 and 2, the printer PR includes the controller CT, the storage unit MR, and the communication unit 37. The communication unit 37 functions as an input unit, through which the printer PR received data transmitted externally and the like. The controller CT includes a central processing unit (CPU) CTa and an image data transmitter CTb.

As illustrated in FIG. 2, the image data transmitter CTb includes a color image data transmitter CT1 and a glossy image data transmitter CT2.

The glossy image data transmitter CT2 includes a color image density acquisition unit CT2*a* (also referred to as a density acquisition unit CT2*a*), a glossy image density decision unit CT2*b*, and a dithering processor CT2*c*.

The controller CT is supplied with transfer image information J3 (refer to FIG. 2) through the communication unit 37 from the external data device 38. The transfer image information J3 includes color image data SN1 as image data of a non-glossy color image. The supplied color image data SN1 is stored in the storage unit MR.

The color image data transmitter CT1 generates image data SN1*y* of an image to be transferred with yellow ink in the ink layer 11Y, image data SN1*m* of an image to be transferred with magenta ink in the ink layer 11M, and image data SN1*c* of an image to be transferred with cyan ink of the ink layer 11C.

The color image data transmitter CT1 sends the image data SN1*y*, SN1*m*, and SN1*c* as color image data SN1A to the thermal head 16.

The sublimation of each color ink can be adjusted by the amount of heat given by the thermal head 16. The lightness and darkness of the transferred image can be represented by density levels.

The glossy image data transmitter CT2 creates glossy image data SN2 to be transferred with metal ink based on the color image data SN1, and sends the same to the thermal head 16. The method of creating the glossy image data SN2 is described later.

The image data transmitter CTb supplies the color image data SN1A for color inks and the glossy image data SN2 for metal ink to the thermal head 16 at the proper timing, which are to be transferred to the transfer frame F (refer to FIG. 4, described later in detail) of the intermediate transfer film 21.

The timing at which the color image data SN1A and glossy image data SN2 are supplied is determined by the whole controller CT, based on the frame mark detection information J2 and the like.

As illustrated in (a) and (b) of FIG. 3, the ink ribbon 11 includes the belt-shaped ribbon base 11*a* and ink layers 11*b*, which are applied and formed on the ribbon base 11*a*. The ink ribbon 11 includes four types of ink layers as the ink layers 11*b*. The four types of ink layers are arranged in a predetermined order to constitute each ink group 11*b*1. The ink groups 11*b*1 are applied repeatedly in the longitudinal direction of the ink ribbon 11 (in the direction of arrow DRa).

To be specific, the ink group 11*b*1 includes the ink layer 11Y of yellow ink, the ink layer 11M of magenta ink, the ink layer 11C of cyan ink, and ink layer 11S of metal ink, which are applied in this order in the longitudinal direction.

The yellow ink, magenta ink, and cyan ink are sublimation ink and transmit light. The metal ink is gray fusion ink, for example. The metal ink contains metal particles, or flakes, and is light impermeable. The metal is aluminum or silver, for example.

The metal ink transferred part formed on the transfer body by transfer of the metal ink (approximately) specularly reflects the incident light with a high directivity. The metal ink transferred part is visually recognized as a metallic glossy silver color.

In each ink layer 11Y, a cueing mark 11*d* is formed at an end of the boundary with the adjacent ink layer 11S of the metal ink.

The ink layers 11Y, 11M, 11C, and 11S have the same length La in the longitudinal direction. Pitch Lap of a group of the ink layers 11*b* is four times the length La.

The ink ribbon sensor 15 is positioned so that when the ink ribbon sensor 15 detects one of the cueing marks 11*d*, the pressure contact position of the thermal head 16 corresponds to the position of the leading edge of the ink layer 11Y in the travel direction. That is, the travel path length from the pressure contact position to the position of detection by the ink ribbon sensor 15 is an integral multiple of the pitch Lap.

Figure 4:
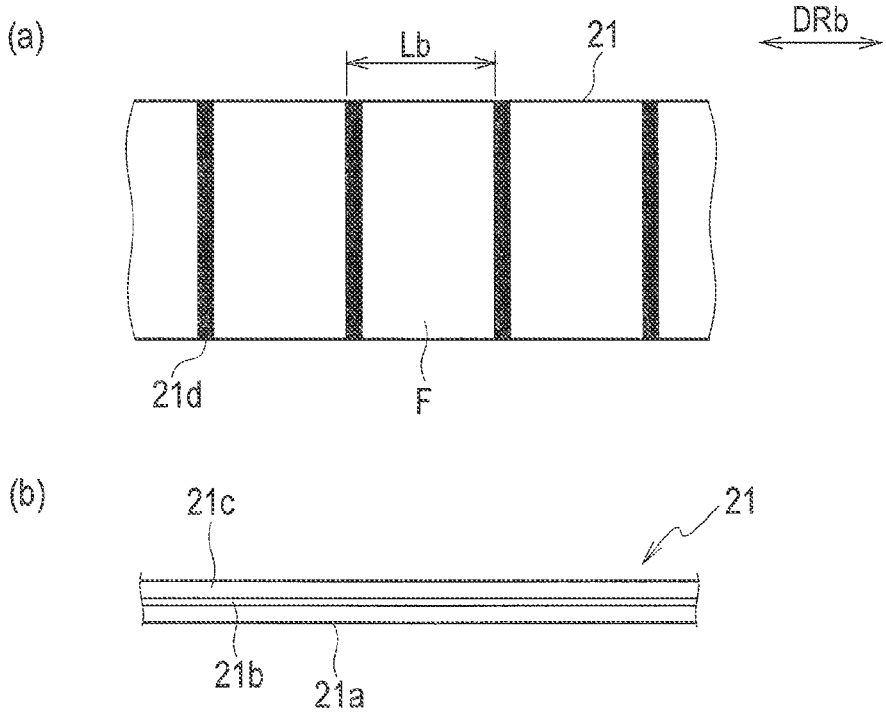
FIG. 4 is a plan view and a side view illustrating an intermediate transfer film 21 used in the printer PR.

As illustrated in (a) and (b) of FIG. 4, the intermediate transfer film 21 includes a belt-shaped film base 21*a*, a release layer 21*b*, and a transfer image receiving layer 21*c*. The release layer 21*b* and the transfer image receiving layer 21*c* are laid on the film base 21*a*.

The film base 21*a* has the same width as the ribbon base 11*a* of the ink ribbon 11. In the film base 21*a* or the transfer image receiving layer 21*c*, the frame marks 21*d* are repeatedly formed with a predetermined pitch Lb in the longitudinal direction (in the direction of arrow DRb). Each frame mark 21*d* is formed across the entire width. The pitch Lb is equal to the length La in the ink ribbon 11 (Lb=La).

The transfer frames F are regions partitioned at regular intervals of the pitch Lb in the intermediate transfer film 21. Hereinafter, the transfer frames F are referred to as the frames F. The frame marks 21*d* are provided at boundaries of the frames F to partition the frames F so that the plural frames F are arranged side by side in the longitudinal direction of the intermediate transfer film 21.

The frame mark sensor 25 (refer to FIG. 1) is positioned so that when the frame mark sensor 25 detects one of the frame marks 21*d*, the pressure contact position of the thermal head 16 corresponds to the position of the leading edge of the frame mark 21*d* in the travel direction. That is, the travel path length from the pressure contact position to the position of detection by the frame mark sensor 25 is an integral multiple of the pitch Lb. The travel path length is four times the pitch Lb, for example.

In the transfer device 51, the intermediate transfer film 21 and the ink ribbon 11 are laid so that the transfer image receiving layer 21*c* directly faces the ink layer 11*b*, as illustrated in FIG. 5.

The transfer image receiving layer 21*c* receives and fixes the inks of the ink layers 11Y, 11W, and 11C, which are heated and sublimated, and the metal ink of the ink layer 11S, which is heated and fused.

When the thermal head 16 is in pressure contact with the ink ribbon 11 as illustrated in FIG. 5, the ink of the ink layer 11*b*, which is pressed against the transfer image receiving layer 21*c*, is transferred to form and print an image in the transfer image receiving layer 21.

In the transfer process, the color inks of the ink layers 11Y, 11M, and 11C are transferred according to a heating pattern corresponding to the color image data SN1A supplied to the thermal head 16. The metal ink of the ink layer 11S is transferred according to a heating pattern, corresponding to the glossy image data SN2 supplied to the thermal head 16.

The transfer device 51, described above in detail, is configured so that the ink ribbon 11 and the intermediate transfer film 21 loaded by the user can move in the longitudinal direction, while being brought into contact with each other by the thermal head 16.

Figure 6:
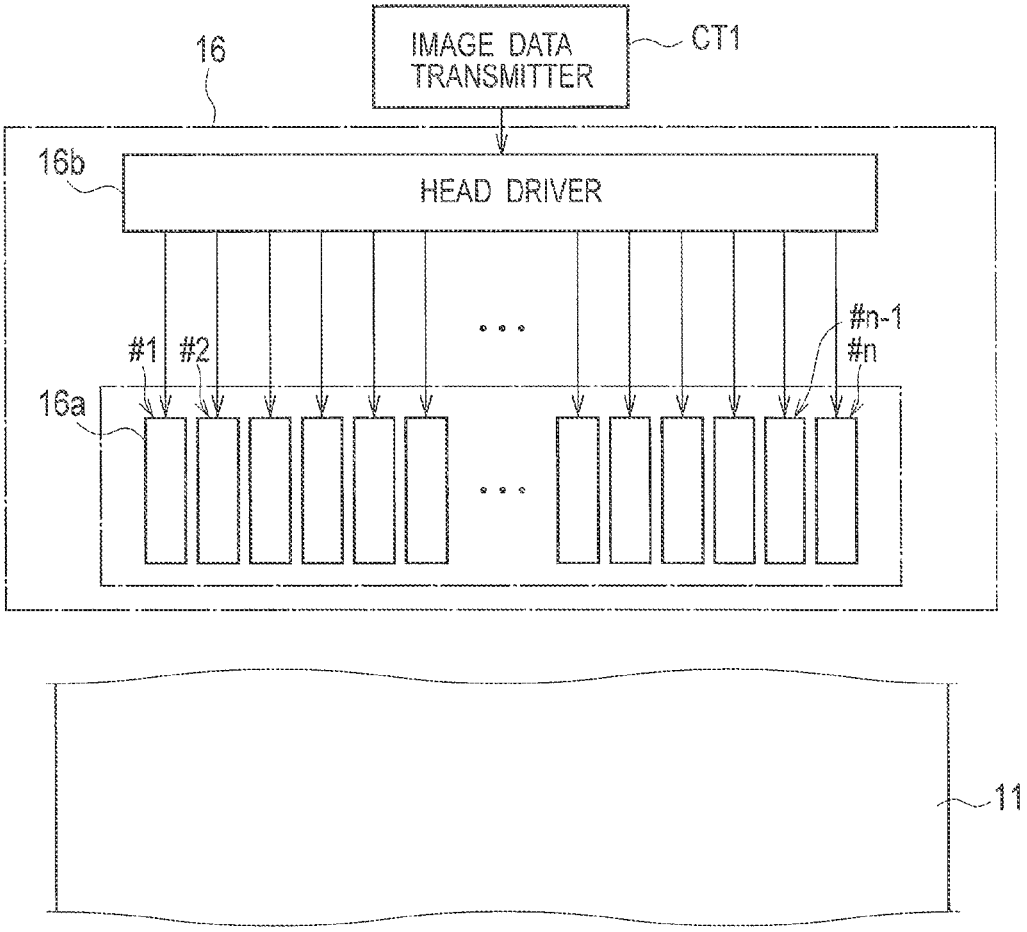
FIG. 6 is a diagram illustrating the thermal head 16.

As illustrated in FIG. 6, the thermal head 16 includes n (n is an integer equal to or greater than 2) heating resistors 16*a* (#1 to #n) arrayed in the width direction of the ink ribbon 11. The thermal head 16 includes a head driver 16*b*, which energizes the plural heating resistors 16*a* independently in accordance with the color image data SN1 and glossy image data SN2. The heating resistors 16*a* include 300 heating resistors arrayed side by side per 1 inch, for example.

The head driver 16*b* energizes each of the plural heating resistors 16*a*, based on the color image data SN1A used for transfer of the color ink, and the glossy image data SN2 used for transfer of the metal ink, which are transmitted from the image data transmitter CTb.

An image to be formed does not use every n of the heating resistors 16*a*, and typically uses m of the heating resistors 16*a* (m is an integer equal to or greater than 1, and m<n). The m heating resistors 16*a* are adjacent to each other, and margins must be left at both ends in the direction that the resistors 16*a* are arranged.

That is, (n−m) of the plural heating resistors 16*a* arranged side by side are left as the margins and are not used in image formation. The m of the heating resistors 16*a* are selected from the n heating resistors 16*a* so as to be successive other than at least the heating resistor 16*a* located at an end.

An image is formed with m×LNa (width×length) dots on the intermediate transfer film 21 as an image formed body. Herein, LNa indicates the number of lines of the image to be transferred in the longitudinal direction. The number LNa corresponds to the number of lines that can be energized independently.

When the printer PR forms an image of 300 dpi on a card with the external dimensions of 86 mm×54 mm as a transfer body for retransfer, m is about 1000, and LNa is about 600.

The transfer device 51 moves the ink ribbon 11 and the intermediate transfer film 21, which are in close contact with each other while properly energizing each heating resistor 16*a* of the thermal head 16, based on the color image data SN1A at transfer of the color inks, and based on the glossy image data SN2 at transfer of the metal ink. The transfer device 51 thus transfers and superimposes the inks of the ink layers 11*b* of the ink ribbon 11 in the same frame F of the transfer image receiving layer 21*c* of the intermediate transfer film 21.

Accordingly, a desired glossy color image is transferred to a frame F of the transfer image receiving layer 21*c*. The details of this image-forming operation are described later.

Returning to FIG. 1, the printer PR includes the retransfer device 52. The retransfer device 52 retransfers a part of the image formed in the transfer image receiving layer 21 of the intermediate transfer film 21 as the transfer body in the transfer device 51 to one of the card materials 31*a* as another transfer body to produce each card 31. In FIG. 1, the card materials 31*a* and card 31, which are being conveyed, are illustrated by thick lines.

The retransfer device 52 shares the controller CT with the transfer device 51. The retransfer device 52 includes a retransfer unit ST1, a supply unit ST2, and a delivery unit ST3. The retransfer unit ST1 is provided between the platen roller 26 and the take-up reel 23 on the travel path of the intermediate transfer film 21. The supply unit ST2 supplies the card materials 31*a* to the retransfer unit ST1. The delivery unit ST3 delivers the cards 31 having passed through the retransfer unit ST1.

The retransfer unit ST1 includes a heat roller 41 rotated by the motor M41, an opposite roller 42 provided opposite to the heat roller 41, and a heat roller driver D41. The heat roller driver D41 brings the heat roller 41 close to or away from the opposite roller 42.

The supply unit ST2 includes a reorientation unit ST2*a*, which sandwiches each card material 31*a* and rotates by 90 degrees so that the card material 31*a* is reoriented from the vertical position to the horizontal position.

The supply unit ST2 includes a pick-up roller 33. The pick-up roller 33 rotates so as to raise the rightmost (FIG. 1) of the plural card materials 31*a*, which are standing vertically in the stacker 32.

The supply unit ST2 includes a pair of feeding rollers 34, and plural pairs of conveyance rollers 35. The feeding rollers 34 sandwich and feed each card material 31*a*, raised by the pick-up roller 33 to the reorientation unit ST2*a*, provided above the supply unit ST2. The conveyance rollers 35 feed the cards 31, reoriented to the horizontal position by the reorientation unit ST2*a* to the retransfer unit ST1 in the left side.

The operation of the motor M41 is controlled by the controller CT. The pick-up roller 33, the feeding rollers 34, and the conveyance rollers 35, are driven and rotated by the unillustrated motors under control of the controller CT.

The retransfer device 52 reorients each card material 31*a*, which is standing vertically, and is picked up from the stacker 32 in the supply unit ST2 to the horizontal position in the reorientation unit ST2*a*. The retransfer device 52 then conveys and supplies the reoriented, card material 31*a* to the retransfer unit ST1.

In the retransfer unit ST1, the card material 31*a* is pressed and sandwiched between the heated heat roller 41 and opposite roller 42, together with the intermediate transfer film 21, by the operation of the heat roller driver D41 while being driven to move toward the conveyance unit ST3 by the motor M41. The card material 31*a* is brought into pressure contact with the transfer image receiving layer 21*c* of the intermediate transfer film 21.

Through the aforementioned movement of the card material 31*a* in pressure contact, a partial range of the intermediate image P, formed in the transfer image receiving layer 21*c* by the transfer device 51, is transferred onto the card material 31*a* to form an image Pc. That is, the image Pc is formed by retransfer on the surface of the card material 31*a* as a formed image, thus producing the card 31. The card 31 with the image PC retransferred and formed thereon is conveyed to the conveyance unit ST3, and is stacked and accommodated in an external stocker 36, for example.

The timing at which retransfer is executed is not limited. Retransfer may be executed after the intermediate image P is formed in one of the frames F, before the intermediate image P is formed in the next frame F. Alternatively, retransfer may be executed after the intermediate image P is formed in plural frames F.

The storage unit MR previously stores an operation program for executing the entire operation of the printer PR including the transfer device 51, the transfer image information J3, which is information of an image to be transferred, and the like. The contents stored in the storage unit MR are referred to by the controller CT when needed. The transfer image information J3 is supplied to the controller CT through the communication unit 37 as the input unit from the external data device 38 (refer to FIG. 2), and is stored in the storage unit MR.

Next, a description is given of the method of creating the glossy image data SN2 by the glossy image data transmitter CT2.

Figures 7, 8, 9:
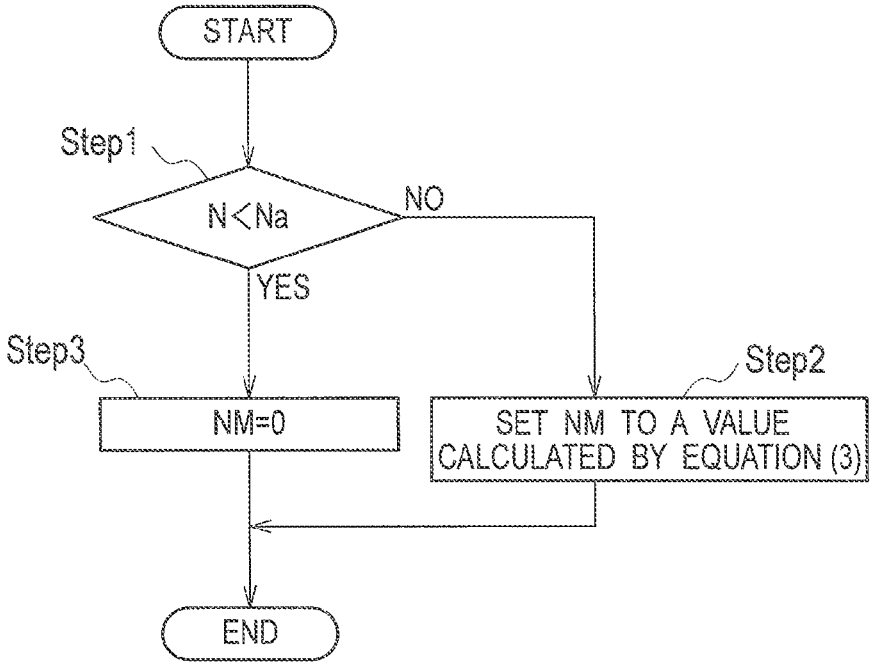
FIG. 7 is a diagram illustrating the data structure of each pixel in color image data SN1.
FIG. 8 is a diagram illustrating R, G, and B values of a pixel Qa.
FIG. 9 is a flowchart illustrating the operation procedure of a glossy image density decision unit CT2*b*.

In the color image data SN1 externally supplied, the data structure of each pixel constituting an image is composed of 8 bits (256 gradations) for each color of red, green, and blue, as illustrated in FIG. 7.

The color image density acquisition unit CT2*a* acquires the density of each pixel included in the color image data SN1 as a density value N through calculation, for example. To be specific, the color image density acquisition unit CT2*a* calculates the density value as the complement number of the luminance value.

To be more specific, the color image density acquisition unit CT2*a* calculates a luminance value Lu by Equation (1). Herein, maxRGB and minRGB are maximum and minimum values among the R, G, and B values of each pixel, respectively.

$$LU=[(\text{maxRGB})+(\text{minRGB})]/2 \quad (1)$$

Next, based on the calculated luminance LU, the density value N is calculated by Equation (2).

$$N=255-LU \quad (2)$$

The color image density acquisition unit CT2*a* calculates the density value N of each pixel and stores in the storage unit MR the calculated density values of all the pixels in the predetermined region as density value information. The predetermined region is properly set in a color image represented by the color image data SN1. The predetermined region may be the entire region of the color image or may be any partial region thereof.

Based on the density value N of each pixel obtained by the color image density acquisition unit CT2*a*, the glossy image density decision unit CT2*b* sets the density value of gloss obtained by transfer of the metal ink of the corresponding pixel as a gloss density value NM.

In the decision process, the gloss density value NM of a pixel, the density value N of which is less than a previously-configured particular density value Na, is a value smaller than the density value N. The gloss density value NM is set to the minimum possible value of the gloss density value NM, for example. This criterion on for the decision is referred to as a first decision criterion. Herein, the gloss density value NM is set to 0 according to the first decision criterion.

On the other hand, for a pixel, the density value N of which is equal to or greater than the particular density value Na, a second decision criterion is applied to calculate the gloss density value NM based on Equation (3).

$$NM=(N-Na)\times[255/(255-Na)] \quad (3)$$

According to the second decision criterion, the gloss density value NM is set larger than the minimum possible value of the gloss density value NM, according to the first decision criterion, for example.

The gloss density value NM, obtained by Equation (3), is a number with a decimal point, the gloss density value NM is rounded to a whole number. The gloss density value NM is a value in a range from 0 to 255 by Equation (3), and is represented as 8 bit data. The minimum possible value of the gloss density value NM is therefore 0.

The particular density value Na is configured so that when the transferred metal inks are scattered in a dot manner in a high-lightness region with a density value which is close to but less than the particular density value Na, the dots are recognized prominently, and the formed image is determined to have poor quality. The particular density value Na is previously set to a proper value by experiments or the like, and is stored in the storage unit MR, for example.

The glossy image density decision unit CT2*b* calculates the gloss density value NM of each pixel in a predetermined region, and stores the gloss density values of all the pixels in the predetermined region as gloss density value information in the storage unit MR. To be specific, for pixels which are intended to be given gloss, the glossy image density decision unit CT2*b* associates each of the pixels with the gloss density value NM, which specifies the density of the gloss.

Based on the gloss density value NM of each pixel decided by the glossy image density decision unit CT2*b*, the dithering processor CT2*c* performs pseudo gradation processing by a dither method (dithering), for example, to create the glossy image data SN2. Using dithering, a desired gloss density can be represented by increasing or decreasing the number of pixels printed with the metal ink per area.

The dithering processor CT2*c* performs pseudo gradation processing for the 8-bit gloss density value of each pixel into 1-bit data to create the glossy image data SN2. The dithering processor CT2*c* stores the glossy image data SN2 in the storage unit MR.

By the aforementioned method, the glossy image data SN2 is created.

Next, a description is given of a specific operation example of the color image data transmitter CT1, and the glossy image data transmitter CT2.

It is assumed, for example, that the R, G, and B values of a certain pixel Qa in the color image data SN1 are 48, 72, and 96, respectively (refer to FIG. 8).

In this case, the color image data transmitter CT1 creates the image data SN1*y*, SN1*m*, and SN1*c* of the respective color inks so that the R, G, and B values for a transferred pixel which is transferred and superimposed on the intermediate transfer film 21 as a pixel corresponding to the pixel Qa, are 48, 72, and 96, respectively. The color image data transmitter CT1 then transmits the created image data to the thermal head 16.

The color image density acquisition unit CT2*a* calculates the density value N of the pixel Qa through Equations (1) and (2) by using the R, G, and B values of the pixel Qa as shown in Equations (4) and (5).

$$LU=(96+48)/2=72 \quad (4)$$

$$N=255-72=183 \quad (5)$$

The glossy image density decision unit CT2*b* determines whether the obtained density value N is less than the particular density value Na (Step 1 in FIG. 9). Herein, the particular density value Na is set to 25 in advance. In this case, as N=183, the density value N is determined to be equal to or greater than the particular density value Na (No in Step 1).

The glossy image density decision unit CT2*b* decides the gloss density value NM, which specifies the gloss given in association with the pixel Qa, based on Equations (3) as shown in Equation (6) (Step 2 in FIG. 9).

$$NM=(183-25)\times[255/(255-25)]\approx175 \quad (6)$$

As illustrated in FIG. 10, it is assumed that the R, G, and B values of a pixel Qb, which is different from the pixel Qa, are 250, 230, and 240, respectively.

In this case, each color ink is transferred and superimposed in accordance with the image data SN1*y*, SN1*m*, and SN1*c*, so that the R, G, and B values of a transferred pixel which is transferred and superimposed on the intermediate transfer film 21 as a pixel corresponding to the pixel Qb, are 250, 230, and 240, respectively.

The color image density acquisition unit CT2*a* calculates the density value N of the pixel Qb through Equations (1) and (2) by using the R, G, and B values of the pixel Qb, as shown in Equations (7) and (8).

$$LU=(250+230)/2=240 \quad (7)$$

$$N=255-240=15 \quad (8)$$

The glossy image density decision unit CT2*b* determines if the obtained density value N is less than the particular density value Na (Step 1 in FIG. 9). In this case as N=15, the density value N is determined to be less than the particular density value Na (Yes in Step 1).

The glossy image density decision unit CT2*b* sets the gloss density value NM, which specifies the gloss given in association with the pixel Qb less than the density value N (less than 15). In this example, the gloss density value NM is set to 0 (Step 3 in FIG. 9).

The metal ink is transferred in the binary manner previously described. The gloss density value NM of each pixel is therefore subjected to pseudo gradation processing by the dithering processor CT2*c* into 1-bit data, and is then outputted as the glossy image data SN2.

As for the data structure of each pixel in the color image data SN1A and glossy image data SN2 outputted from the color and glossy image data transmitters CT1 and CT2, the R, G, and B values are each composed of 8 bits, and the gloss density value NM (a S value in FIG. 11) is composed of one bit.

The metal ink is transferred to the intermediate transfer film 21 in accordance with the glossy image data SN2, described in detail above. In this transfer process for the pixel Qa, the metal ink is transferred in a binary manner by the pseudo gradation processing such as dithering, so that the gloss density corresponding to the gloss density value NM=175 can be obtained. For the pixel Qa, the metal ink is not transferred, since the gloss density value NM is set to 0.

Next, with reference to FIGS. 12 to 19, a description is given of the specific operation and method to form an image on the intermediate transfer film 21 with the transfer device 51, using the color image data SN1A and glossy image data SN2.

The transfer device 51 performs a rewinding operation and a cueing operation in the operation to transfer the color inks of three colors and the metal ink.

The operation procedure described below is a procedure to transfer the intermediate image P to a frame F1 of the intermediate transfer film 21.

Figure 12:
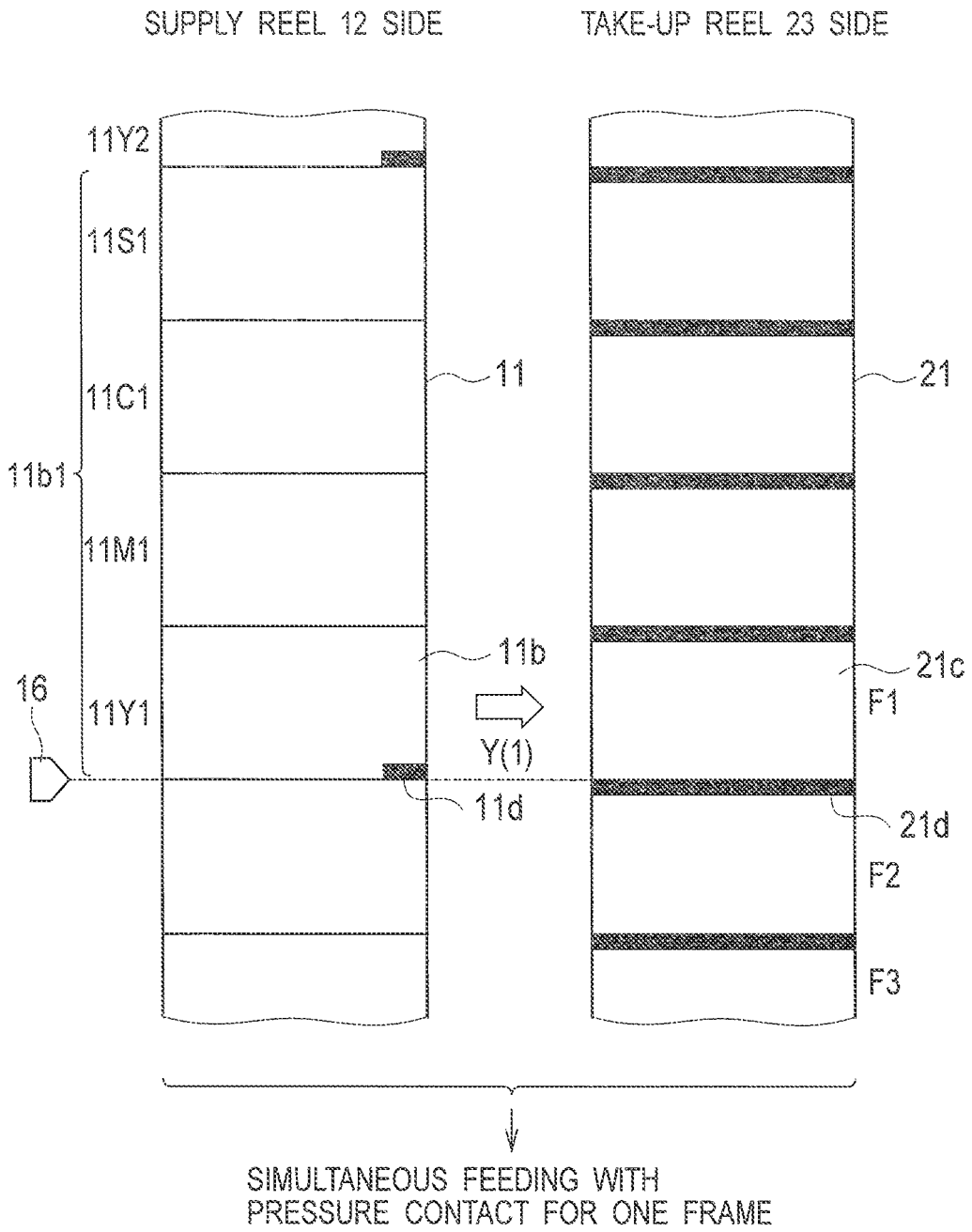
FIG. 12 is a first diagram illustrating an operation to transfer and form an intermediate image P on the intermediate transfer film 21.
Figure 13:
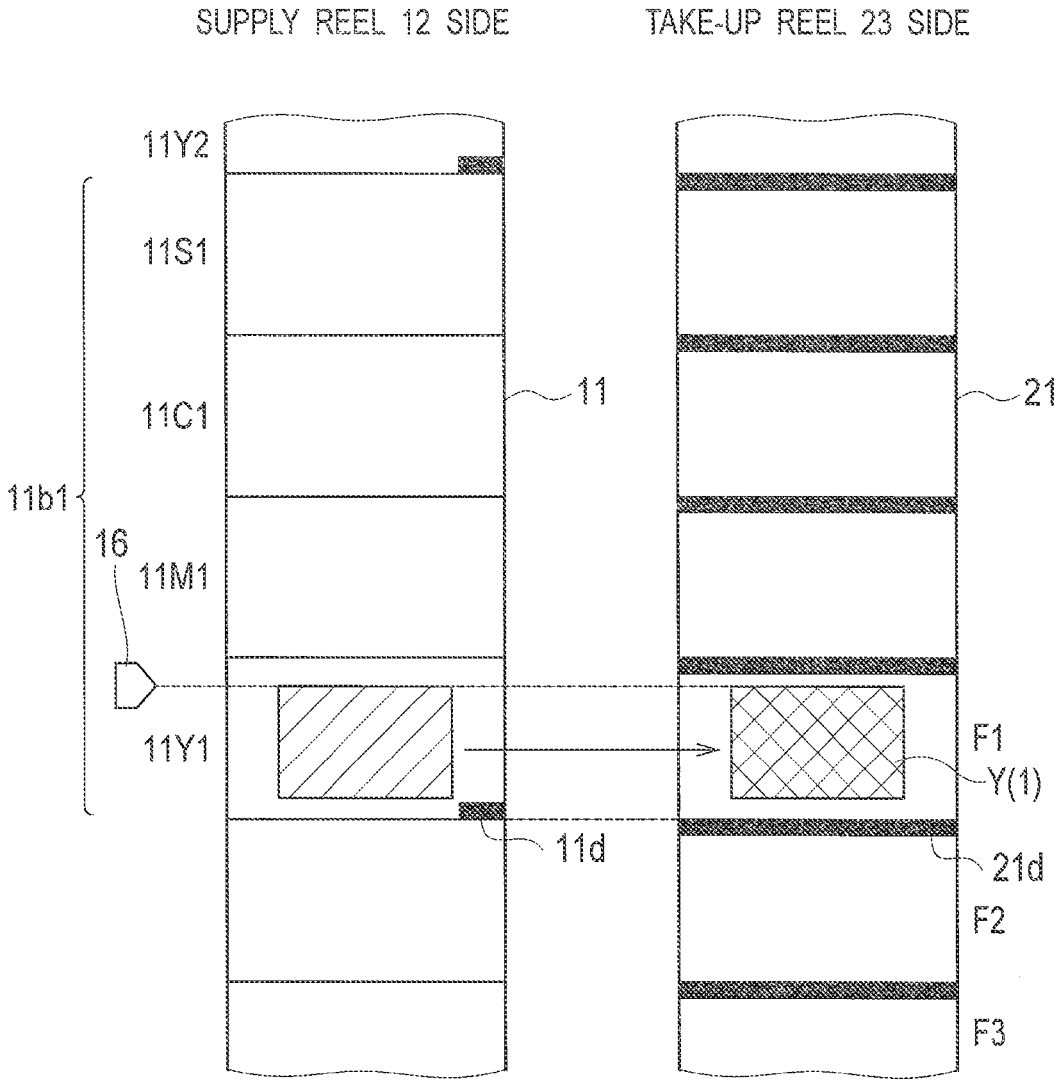
FIG. 13 is a second diagram illustrating the operation to transfer and form the intermediate image P on the intermediate transfer film 21.

FIGS. 12 and 13 illustrate the thermal head 16, which is not movable in the conveyance direction (the longitudinal direction) of the ink ribbon 11, the positions of the ink ribbon 11 and intermediate transfer film 21 relative to the position of the thermal head 16, and the transferred contents.

In FIGS. 12 and 13, the surface of the ink layer 11*b* of the ink ribbon 11 and the surface of the transfer image receiving layer 21*c* of the intermediate transfer film 21, which face each other and are in close contact during the transfer operation, are illustrated side by side.

In FIGS. 12 and 13, the ink layers 11*b* of the ink group 11*b*1 involved in transfer are given serial numbers starting with 1. For example, ink layers 11Y1 to 11S1 indicate ink layers 11Y to 11S of a first ink group 11*b*1.

The frames F are given serial numbers starting with 1 in the order of frames, in which the intermediate image P is transferred and formed. For example, F1 indicates a frame in which the intermediate image P is transferred and formed at first. Images of each ink to be transferred are indicated by serial numbers in brackets. For example, image M(1) refers to the first transfer image transferred with magenta ink (an image of magenta to be formed in the frame F1). Similarly, image C(1) refers to the first transfer image transferred with cyan ink (an image of cyan to be formed in the frame F1).

As illustrated in FIG. 12, the yellow ink layer 11Y1 is aligned with the frame E1 by the cueing operation.

Next, the thermal head 16 is moved to the pressure contact position, and the ink ribbon 11 and intermediate transfer film 21 are brought into contact with each other and are moved downward together in FIG. 12. The ink of the yellow ink layer 11Y1 is therefore transferred to the frame F1, according to the image data SN1*y* to form an image Y(1).

The aforementioned close contact movement is performed by one frame. The feeding direction of the ink, ribbon 11 is the winding direction (the forward direction), and the feeding direction of the intermediate transfer film 21 is the rewinding direction (the backward direction).

FIG. 13 illustrates the state where the image Y(1) is completely transferred to the intermediate transfer film 21. In the frame F1 of the intermediate transfer film 21, the image Y(1) of the yellow ink is transferred and formed. In the ink layer 11Y1 of the ink ribbon 11, the ink in the range (indicated by hatched lines) corresponding to the image Y(1) is thinner than the other range, or is removed completely.

Next, in the frame F1, the image Y(1) is transferred with the ink of the yellow ink layer 11Y1. As illustrated in FIG. 13, ink of the magenta ink layer 11M1 is to be transferred and superimposed, according to the image data SN1*m* as an image M(1).

Figure 14:
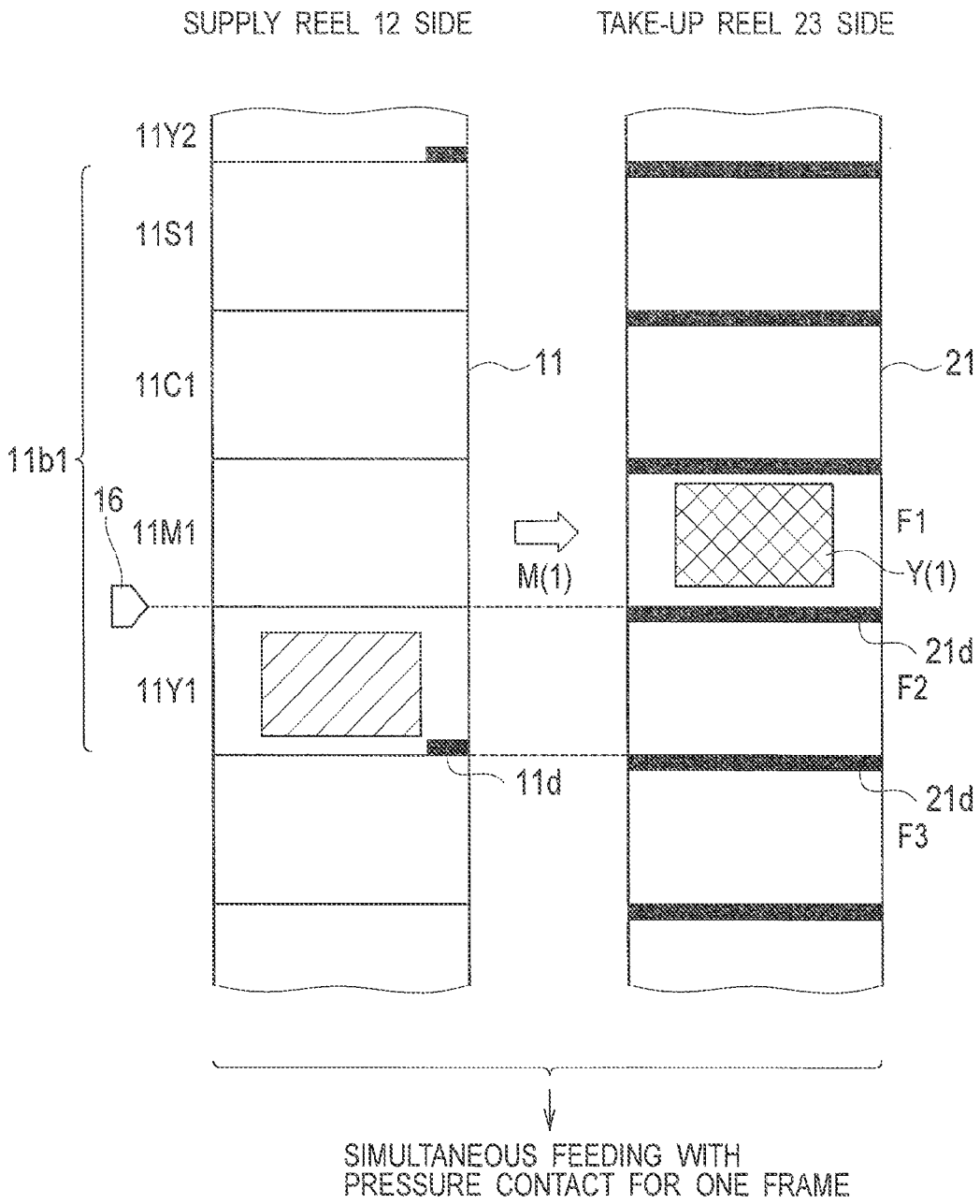
FIG. 14 is a third diagram illustrating the operation to transfer and form the intermediate image P on the intermediate transfer film 21.

Next, as illustrated in FIG. 14, the magenta ink layer 11M1 is aligned with the frame F1 by the cueing operation.

In this cueing operation, the thermal head 16 is separated from the ink ribbon 11 at the separation position. The ink ribbon 11 is fed downward from the state of FIG. 13 (forward feeding), while the intermediate transfer film 21 is rewound upward from the state of FIG. 13 (forward feeding).

Next, the thermal head 16 is moved to the pressure contact position. The ink ribbon 11 and intermediate transfer film 21, in close contact with each other, are move downward in FIG. 14. The ink of the magenta ink layer 11M1 is transferred to the frame F1, according to the image data SN1*m* to form the image M(1).

Figure 15:
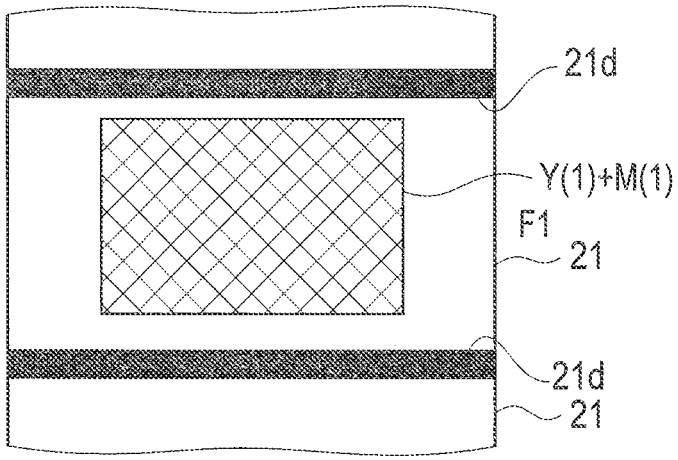
FIG. 15 is a fourth diagram illustrating the operation to transfer and form the intermediate image P on the intermediate transfer film 21.

In the frame F1, an image composed of the image Y(1) and image M(1) superimposed on each other is formed as illustrated in FIG. 15.

In a similar manner, the ink of the cyan ink layer 11C1 is transferred and superimposed in the frame F1, according to the image data SN1*c* as an image C(1). In the frame F1, an image composed of the images Y(1), M(1), and C(1) superimposed on each other is thereby formed.

In a similar manner, furthermore, the metal ink of the ink layer 11S1 is transferred and superimposed in the frame F1, to form an image S(1) of the glossy image Ps (refer to FIG. 21B) according to the glossy image data SN2 created by the glossy image data transmitter CT2.

Figure 16:
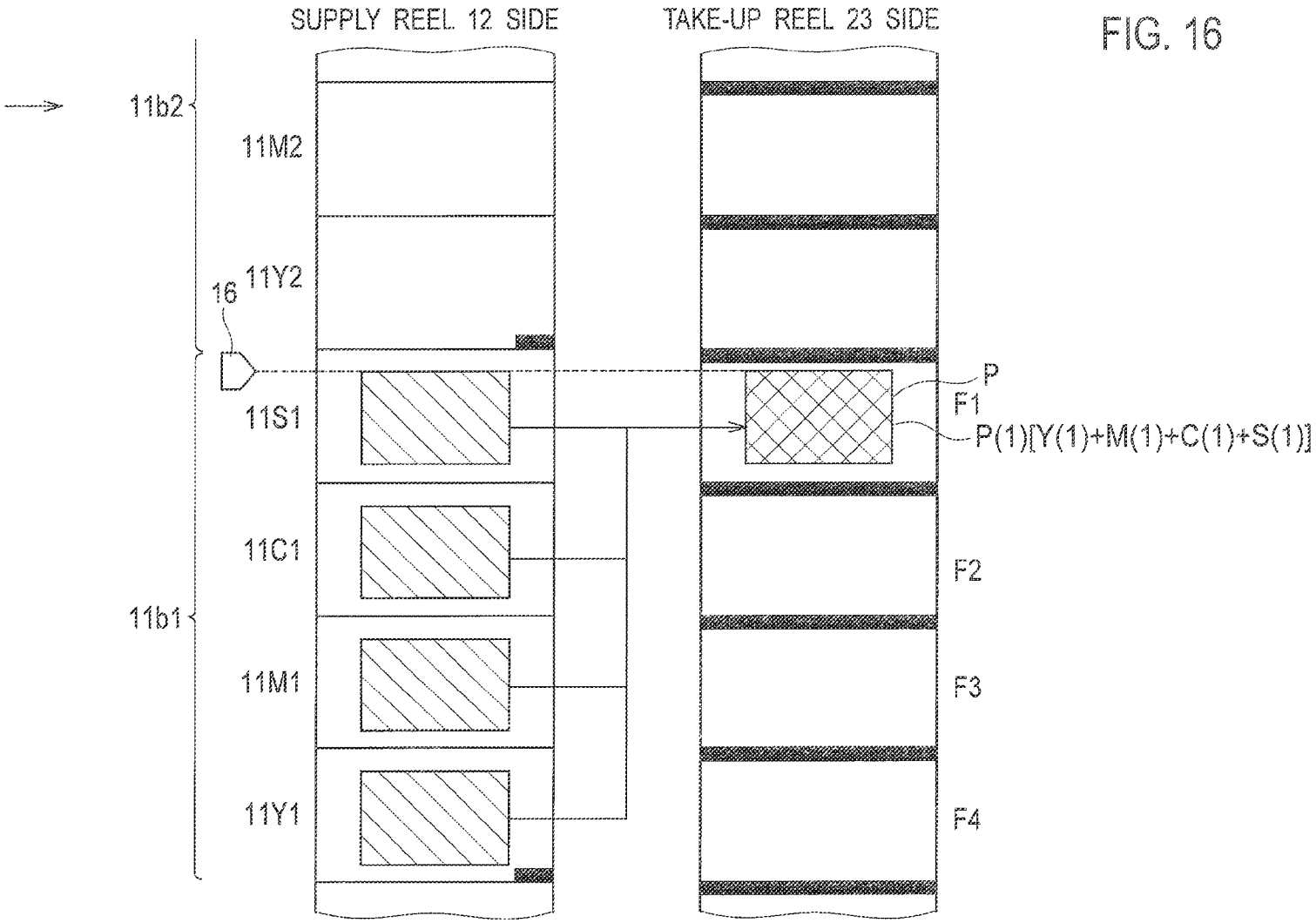
FIG. 16 is a fifth diagram illustrating the operation to transfer and form the intermediate image P on the intermediate transfer film 21.
Figure 17:
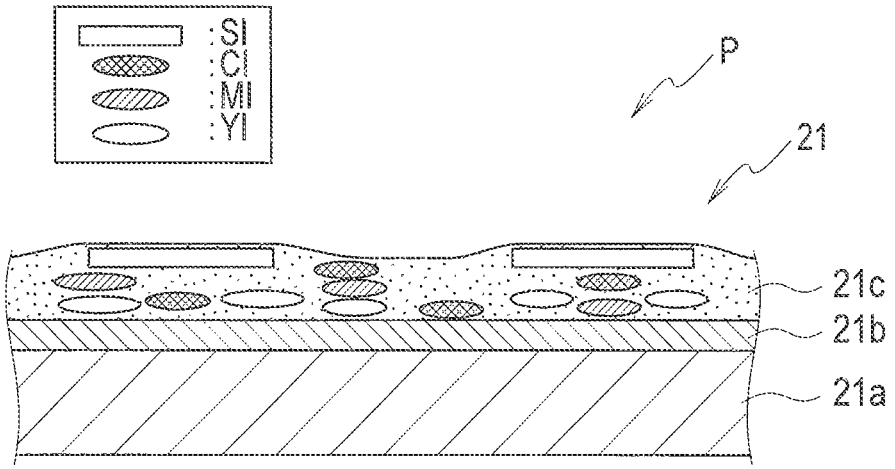
FIG. 17 is a schematic cross-sectional view illustrating the intermediate image P formed on the intermediate transfer film 21.

FIG. 16 illustrates the state where the image S(1) of the metal ink as the fourth color is completely transferred. In the frame F1, the images Y(1), M(1), C(1), and S(1) are transferred and superimposed, to form an image P(1) as the intermediate image P. The schematic cross-sectional view of the intermediate transfer film 21 in this state is illustrated in FIG. 17.

The transfer image receiving layer 21*c* includes dye Y1 (indicated by white ellipses) of the yellow ink sublimated and transferred, dye MI (indicated by hatched ellipses) of the magenta ink, dye CI (indicated by cross-hatched ellipses) of the cyan ink, and pigment SI of the metal ink (indicated by rectangles).

The pigment SI of the metal ink is transferred at the end, and is therefore received in the far side from the film base 21*a* in the transfer image receiving layer 21*c*.

The image P(1) is composed of the metal ink transferred based on the glossy image data SN2. As described above, in the region with the density less than the previously set particular density value Na, the metal ink is not transferred. In the region with the density equal to or greater than the particular density value Na, the metal ink is transferred so that the shades of gloss can be visually recognized by area modulation of the pseudo gradation processing.

In the frames subsequent to the frame F1, an image P(2) and subsequent images can be formed in the same way as the image P(1) is formed in the frame F1. A part of the intermediate image P formed in each frame F is retransferred to the corresponding one of the card materials 31*a* as the image Pc by the retransfer device 52.

Figure 18:
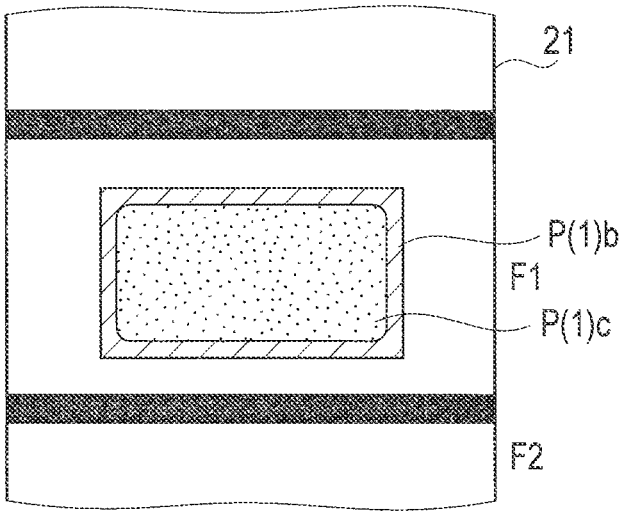
FIG. 18 is a plan view illustrating the intermediate transfer film 21 after the intermediate image P is retransferred.

FIG. 18 illustrates the state of the intermediate transfer film 21 after the image P(1) formed in the frame F1 (illustrated in FIG. 16) is retransferred to the card material 31*a*. To be specific, a part of the image P(1) is transferred to the card material 31*a* to form a retransfer range P(1)*c* (dotted part).

Figure 19:
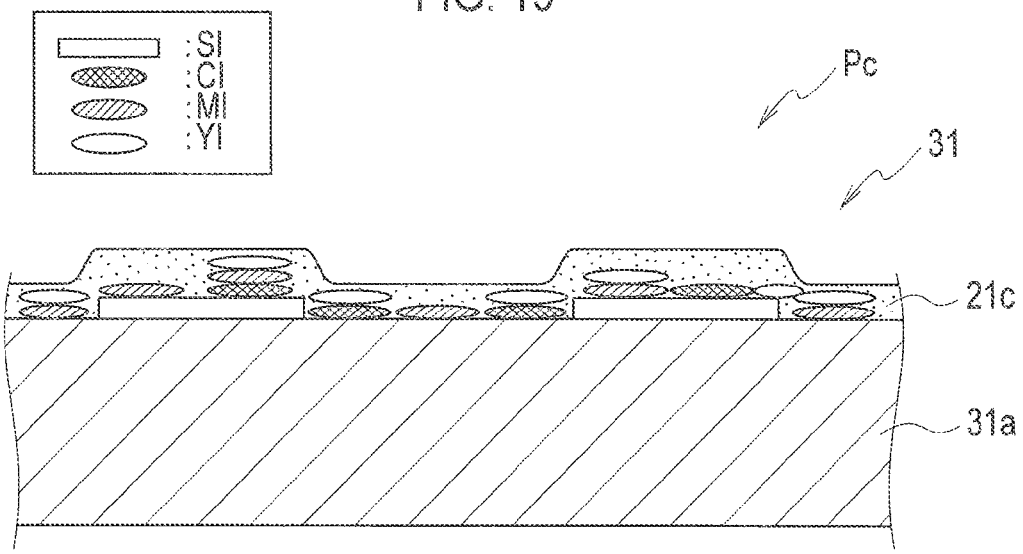
FIG. 19 is a schematic cross-sectional view illustrating a card 31 on which an image Pc is formed by retransfer of the intermediate image P.

FIG. 19 is a partial cross-sectional view of the card 31 with the image retransferred thereon. The transfer image receiving layer 21*c* is transferred to the entire surface of the card material 31*a*, which is the card 31 with no image transferred thereon. The surface of the transfer image receiving layer 21*c*, opposite to the ribbon base 11*a*, is located on the card material 31*a* side after the transfer process. The metal ink is therefore located on the card material 31*a* side.

When part of the intermediate transfer film 21 is transferred to the card material 31*a*, where the metal ink is transferred and superimposed on the color ink transferred part, the color inks are laid on the metal ink on the card material 31*a*.

Figure 20:
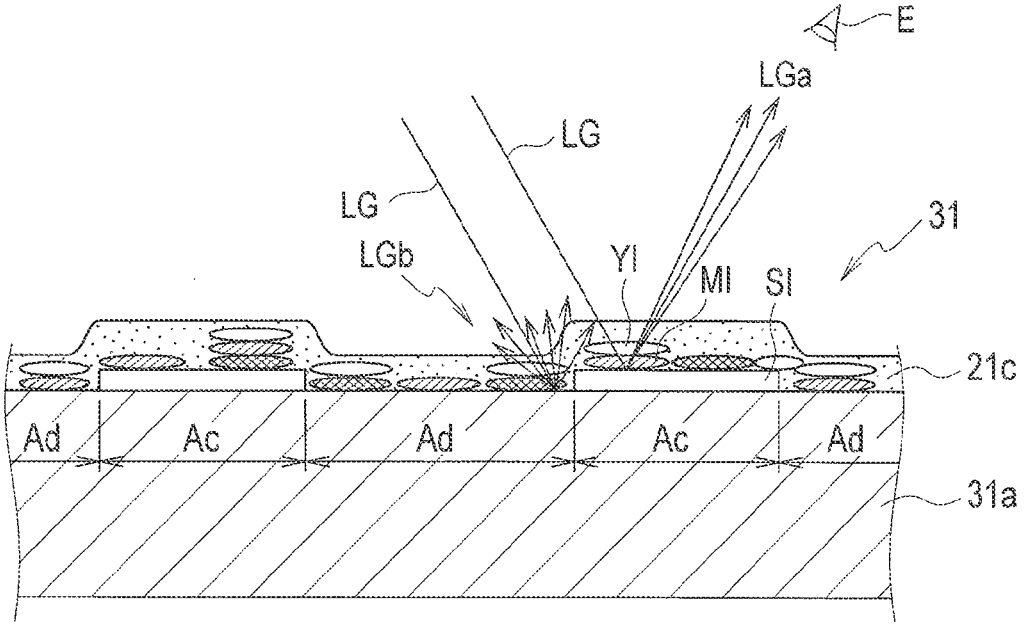
FIG. 20 is a schematic cross-sectional view illustrating light reflected on metal ink in the image Pc formed on the card 31.

FIG. 20 is a schematic view illustrating the card 31 (the cross sectional view thereof is illustrated in FIG. 19) irradiated with light LG.

In FIG. 20, metal ink transferred sections Ac with the metal ink transferred thereto (approximately) regularly reflects the light LG with a high directivity, and outputs the same as reflection light LGa. Since the color inks transmit light, the reflected light LGa is recognized as glossy color reflecting the colors of the color inks laid on the metal ink.

When the light LG is incident on the surface of the card material 31*a*, metal ink non-transferred sections Ad with no metal ink transferred thereon diffusely reflects, as indicated by diffuse reflection light LGb for the surface of the card material 31*a* that has a surface roughness typical as a resin plate.

When an observer's eye E is located in the outgoing direction of the reflected light LGa, the metal ink transferred sections Ac are visually recognized as metal glossy color regions, remarkably brighter than the metal ink non-transferred sections Ad.

On the other hand, the observer's eye E is not located in the outgoing direction of the reflected light LGa, and the eye E receives the diffusely reflected light LGb from the metal ink non-transferred sections Ad much more than the reflected light LGa from the metal ink transferred sections Ac. The metal ink transferred sections Ac are visually recognized as a dark region.

Figure 21:
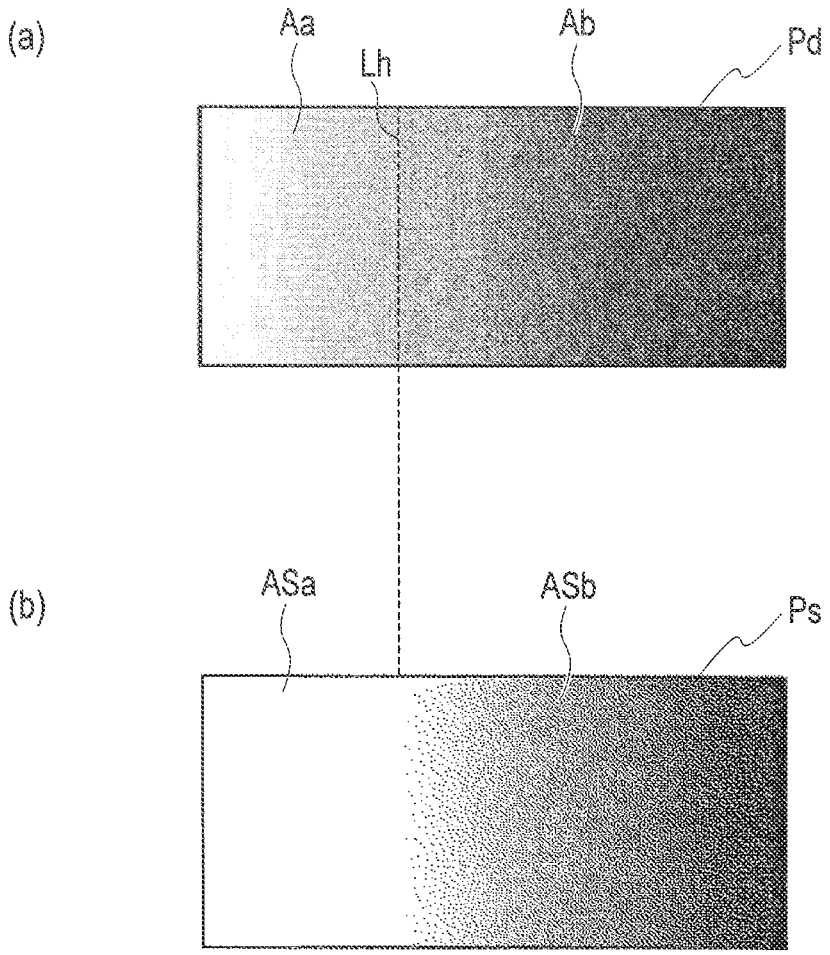
FIG. 21 is a diagram illustrating a glossy image Ps by the glossy image data SN2.

Next, a description is given of a case where the transfer image information J3, including the color image data SN1 of a color image Pd with a density as illustrated in (a) of FIG. 21, is supplied to the controller CT.

As illustrated in (a) of FIG. 21, the color image Pd is a horizontally-long rectangle. The density value N of pixels located at the left end of the color image Pd is 0 as the minimum density, and the density value N of pixels located at the right end is 255 as the maximum density. In the color image Pd, the density value N of the pixels increase linearly, from the left end to the right end.

Dashed line Lh, illustrated in (a) of FIG. 21, indicates the positions of pixels the density value N of which is 25. The value of 25 of the density value N is stored as the particular density value Na in the storage unit MR.

If the transfer printing with the metal ink is performed through pseudo gradation processing so that the density value N in the area Aa on the left side of the dashed line Lh is the same as the density value N of the color image Pd, the transferred metal ink is scattered in the form of dots, and the formed image has poor quality.

In the printer PR, the color image data SN1 of the color image Pd is processed based on Equations (1) to (3), described above by the color image density acquisition unit CT2*a* and glossy image density decision unit CT2*b*. In other words, the gloss density value NM is decided based on the first and second decision criteria.

The color image data SN1 of the color image Pd is further subjected to dithering by the dithering processor CT2*c* into the glossy image data SN2 of the glossy image Ps, having the shades of gloss as illustrated in (b) of FIG. 21.

In (b) of FIG. 21, the gloss density values NM are 0 in the region ASa on the left side of the dashed line Lh. In the region ASb on the right side of the dashed line Lh, the gloss density value NM of the pixels located at the left end is the lowest density of 0, and the gloss density value NM of the pixels located at the right end is the highest density of 255. In the region ASb, the gloss density value NM increases linearly from the left end to the right end.

As apparent from (a) and (b) of FIG. 21, transfer printing with the metal ink is not performed in the region ASa of the glossy image Ps, which corresponds to the region Aa of the color image Pd. In the region ASb of the glossy image Ps, which corresponds to the region Ab of the color image Pd, the metal ink is transferred and printed so that the gloss density value NM increases as the density value N of the color image Pd increases from the left end to the right end.

The printer PR forms a glossy color image so that the transferred metal ink is not dispersedly recognized in a low-density region. The formed glossy color image has high quality.

As described in detail according to the printer PR of Example 1, the metal ink transferred region is controlled so that little or no metal ink transferred part is produced in a high-lightness region in the formed image.

For example, the particular density value Na is configured based on a transfer image of color ink. The area of the image in which the density value is less than the particular density value Na is determined to be a high-lightness region. In the high lightness region, the metal ink is transferred so that the density characteristics of the metal are suppressed more than the density characteristics of the color inks.

It is therefore possible to transfer and form a glossy color image on the transfer body, such as a card with high quality. Moreover, it is possible to manufacture a card with a high-quality glossy color image formed on the surface thereof.

Example 2

Figure 22:
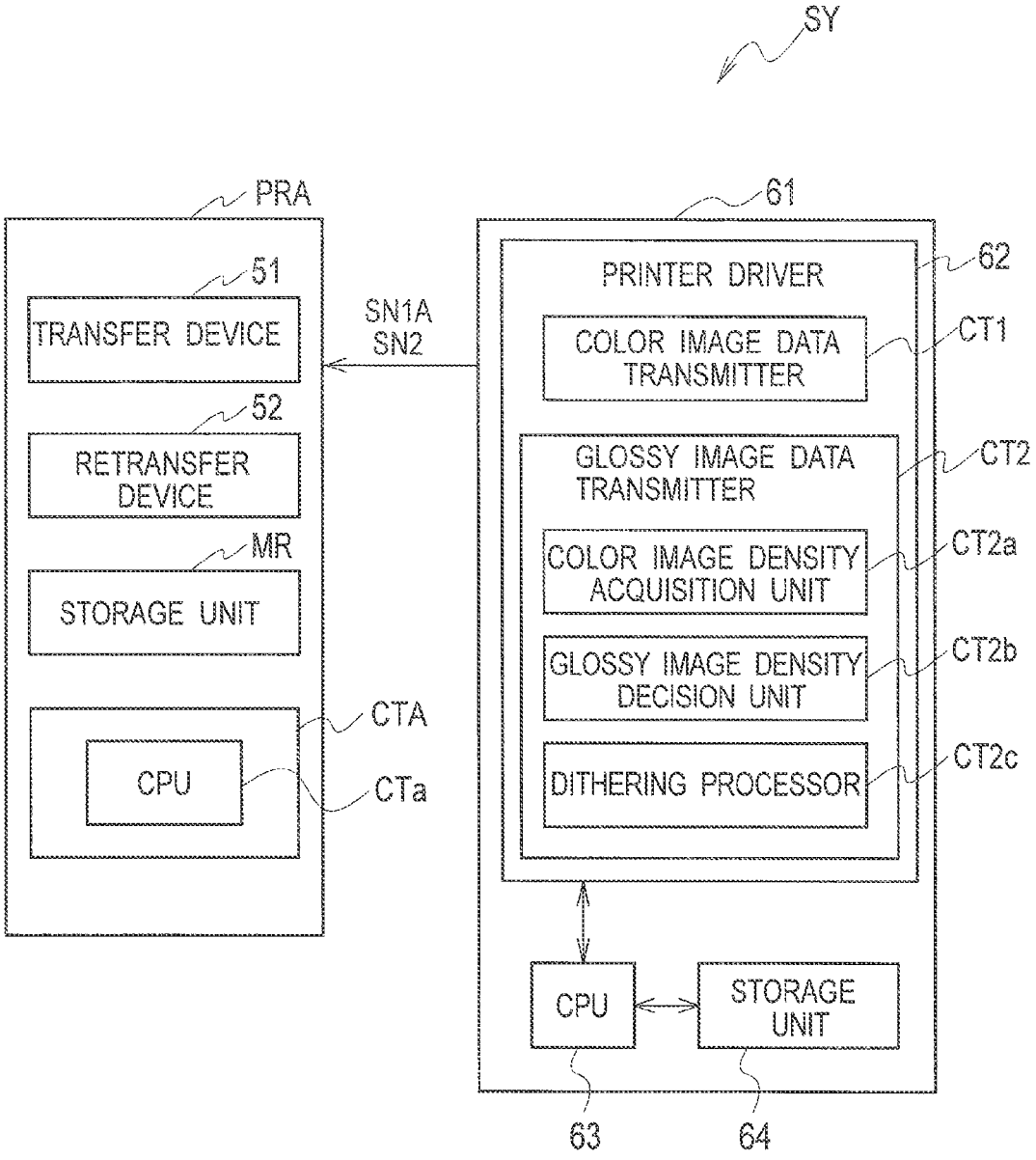
FIG. 22 is a block diagram illustrating the configuration of a printing system SY of Example 2.

In the printer PR as Example 1, the image data transmitter CTb is provided for the controller CT. However, the printer is not limited to the configuration of Example 1. The image data transmitter CTb may be included in an external computer 61, which constitutes a printing system together with the printer. As Example 2, a printing system SY as an example of the printing system is described. FIG. 22 illustrates a schematic configuration of the printing system SY.

The printing system SY includes a printer PRA and the computer 61. The printer PRA differs from the printer PR of Example 1 in including a controller CIA not including the image data transmitter CTb instead of the controller CT.

The printer PRA includes the controller CTA, including a central processing unit CTa, the storage unit MR, the transfer device 51, and the retransfer device 52.

On the other hand, the computer 61 includes a central processing unit 63, a storage unit 64, and a printer driver 62 for driving the printer PRA.

The printer driver 62 includes a block corresponding to the image data transmitter CTb in the printer PR. The printer driver 62 includes the color image data transmitter CT1, and the glossy image data transmitter CT2.

The glossy image data transmitter CT2 includes the color image density acquisition unit CT2*a*, glossy image density decision unit CT2*b*, and dithering processor CT2*c*. The glossy image data SN2 is created by the glossy image data transmitter CT2 of the printer driver 62.

The color image data SN1A and glossy image data SN2 are created by the color image data transmitter CT1 and glossy image data transmitter CT2, respectively, and are sent to the printer PRA by wire or wirelessly. The printer PRA and computer 61 are connected via the Internet, for example.

The creation of the glossy image data SN2 in the computer 61, and the transfer operation and retransfer operation in the printer PRA do not need to be executed successively.

The methods of creating the color image data SN1A and glossy image data SN2 are the same as those of Example 1. The transfer and retransfer operations in the printer PRA are the same as those of the printer PR of Example 1, and provide the same effects as those of Example 1.

The present invention is not limited to the configurations and procedures of Examples 1 and 2, and can be changed without departing from the scope of the present invention.

The way to decide the gloss density value NM in the glossy image density decision unit CT2*b* is not limited to the way based on Equations (3) described above and the like. This is described with reference to FIG. 23.

Figure 23:
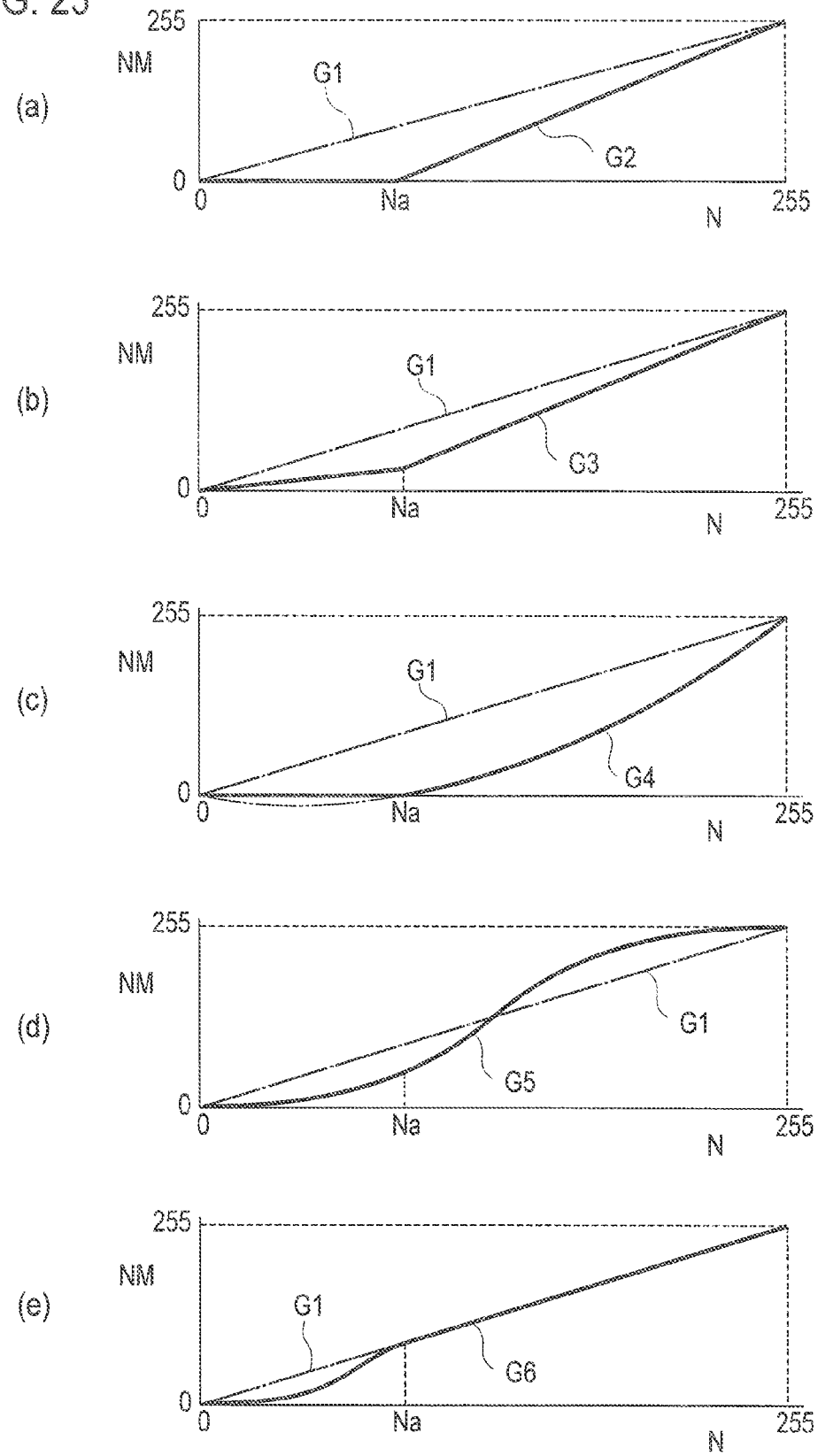
FIG. 23 is a group of diagrams illustrating modifications of a method of creating the glossy image data SN2.

(a) of FIG. 23 is a graph representing the contents of decision by Equations (3) described above. The horizontal axis of (a) of FIG. 23 represents the density value N of a color image. The density value N is 0 at the left end, and is 255 at the right end. The vertical axis represents the gloss density value NM decided by the glossy image density decision unit CT2*b*.

The thick line G2 illustrates the relationship between the density value N and gloss density value NM. A dashed dotted line G1 illustrates the case where the density value N increases linearly.

In (a) of FIG. 23, as illustrated by the thick line G2, the gloss density value NM is 0 when the density value N is from 0 to the particular density value Na. The gloss density value NM increases linearly with the density value N when the density value N is equal to or greater than the particular density value Na.

(b) to (e) of FIG. 23 are modifications of (a) of FIG. 23. The thick lines G3 to G6 illustrate modifications of the relationship between the density value N and gloss density value NM.

In (b) of FIG. 23 as illustrated by the thick line G3, the gloss density value NM increases linearly at a rate smaller than that of the dotted dashed line G1 with the density value N when the density value N is from 0 to the particular density value Na. The gloss density value NM increases linearly at a rate larger than that of the dotted dashed line G1 with the density value N when the density value N is equal to or greater than the particular density value Na.

In (c) of FIG. 23, as illustrated by the thick line G4, the gloss density value NM is 0 when the density value N is from 0 to the particular density value Na and increases in a curved manner with the density value N when the density value N is equal to or greater than the particular density value Na.

In (d) of FIG. 23, as illustrated by the thick line G5, the gloss density value NM is smaller than the dotted dashed line G1, and increases in a curved manner with the density value N when the density value N is from 0 to the particular density value Na. The gloss density value NM is partially equal to or greater than the dashed dotted line G1, and increases in a curved manner with the density value N when the density value N is equal to or greater than the particular density value Na.

In (e) of FIG. 23 as illustrated by the thick line G6, the gloss density value NM is smaller than the dotted dashed line G1, and increases in a curved manner with the density value N when the density value N is from 0 to the particular density value Na. The gloss density value NM increases linearly in the same manner as the dotted dashed line G1 with the density value N when the density value N is equal to or greater than the particular density value Na.

As described above, the way to decide the gloss density value NM in the glossy image density decision unit CT2*b* is not limited to the way illustrated in (a) of FIG. 23 and may be configured as illustrated in (b) to (e) of FIG. 23.

In the example illustrated in (a) of FIG. 23 described in Example 1, and modifications described with reference to (b) to (e) of FIG. 23, the gloss density value NM, decided according to the second decision criterion, is larger than the minimum possible value of the gloss density value NM, according to the first decision criterion. To be more specific, the gloss density value NM, decided according to the second decision criterion, is set to a value larger than the maximum possible value of the gloss density value NM, according to the first decision criterion.

By setting the gloss density value NM decided according to the second decision criterion larger than the maximum possible value of the gloss density value NM according to the first decision criterion, the gloss density value NM decided according to the second decision criterion when the density value N of a pixel is equal to or greater than the particular density value Na is always larger than the gloss density NM decided according to the first decision criterion when the density value N is less than the particular density value Na. Accordingly, the gradation of gloss in the glossy image Ps is recognized more naturally.

In the above description, the ink ribbon includes the ink layers of four colors in total: three color (yellow, magenta, and cyan) inks, and metal ink. However, the ink ribbon may include ink layers of five colors in total: four color (yellow, magenta, cyan, and black) inks, and metal ink. The operation in the case of using the ink ribbon including the five color ink layers can be executed in the same manner as in the case of using the ink ribbon 11 of four colors, except for the execution of an additional operation of transferring and superimposing black ink.

The region (referred to as a gloss target region), for which the glossy image data SN2 is created by the glossy image data transmitter CT2, needs to be at least a part of the image region corresponding to the color image data SN1.

The gloss target region may include plural regions in one color image. When there are plural gloss target regions, the particular density value Na used for each region may be different from each other.

The information that specifies the gloss target region and the particular density value and density change characteristics used when creating the glossy image data SN2 corresponding to each gloss target region, can be previously configured by a user for each set of color image data SN1, and included in the transfer image information J3.

The printers PR and PRA are retransfer printers, but may be transfer devices which manufacture a product such as a card, including an image formed by transfer from the ink ribbon 11 without using the retransfer unit ST1.

To be specific, for example, the printer of the present invention may be a transfer device which cuts out the frames F of the intermediate transfer film 21 with an image transferred thereon into a predetermined shape such as film cards. The printer may be a transfer device which directly transfers an image to the transfer body such as a card instead of the intermediate transfer film 21.

In such a transfer device that produces a product without performing retransfer, metal ink is transferred after the color inks are transferred in the same manner as the transfer operation in the printers PR and PRA when the transfer body transmits light to which each ink from the ink ribbon 11 is transferred and superimposed.

This allows a glossy image to be visually recognized when the transfer body is seen from the opposite side to the surface, on which the images are transferred.

When the transfer body does not transmit light to which each ink from the ink ribbon 11 is transferred and superimposed, the metal ink for a glossy image is transferred first, and the color ink of each color image is then transferred.

The formed image therefore has a structure in which the metal ink is laid on the side closest to the transfer body, and color inks are laid on the metal ink. This allows a glossy image to be visually recognized when the transfer body is seen from the side to which the images are transferred.

The particular density value Na is not limited to a value previously configured and stored in the storage unit MR. The particular density value Na may be configured corresponding to each of color images as raw images and may be included in the transfer image information J3. The particular density value Na can be configured arbitrarily, and is not limited to 25 described above.

What is claimed is:

1. A printer comprising:

an input unit configured to receive first image data corresponding to a first print image of a first ink, the first ink being a color ink comprising yellow, magenta, and cyan inks;

a density acquisition unit configured to acquire a density value of each pixel included in the first image data;

a glossy image density decision unit configured to set a gloss density value which specifies the density of gloss to be added to the pixel to a minimum possible value of the gloss density value, when the density value of the pixel is less than a predetermined value, and sets the gloss density value to a value larger than the minimum possible value, when the density value of the pixel is equal to or greater than the predetermined value;

a dithering processor configured to perform dithering based on the set gloss density value to create second image data corresponding to a second print image of a second ink, the second ink being metal ink containing metal flakes for providing the first print image with a metal glossy color; and a printing unit configured to print the first and second print images on a print first body to form a glossy image on the first print body, wherein the first image data includes red, green, and blue data;

the density acquisition unit calculates a luminance value Lu based on Equation (1), and calculates the density value N based on Equation (2) of each pixel, where maxRGB and minRGB are respectively maximum and minimum values among red, green, and blue values of each pixel; and $$LU=[(\text{maxRGB})+(\text{minRGB})]/2 \quad (1)$$

$$N=255-LU \quad (2)$$

the glossy image density decision unit calculates the gloss density value NM based on Equation (3), when the density value N is equal to or greater than Na as the predetermined value, where Dmax is a maximum possible value of the first image data, $$NM=(N-Na)\times[D\text{max}/(D\text{max}-Na)] \quad (3).$$

2. A printing system comprising:

a printer; and a printer driver configured to send image data to the printer, wherein the printer driver comprises:

an input unit configured to receive first image data corresponding to a first print image of a first ink, the first ink being a color ink comprising yellow, magenta, and cyan inks;

a density acquisition unit configured to acquire a density value of each pixel included in the first image data;

a glossy image density decision unit configured to set a gloss density value which specifies the density of gloss to be added to the pixel to a minimum possible value of the gloss density value, when the density value of the pixel is less than a predetermined value, and to set the gloss density value to a value larger than the minimum possible value, when the density value of the pixel is equal to or greater than the predetermined value; and a dithering processor configured to perform dithering based on the set gloss density value to create second image data corresponding to a second print image of a second ink, the second ink being metal ink containing metal flakes for providing the first print image with metal glossy color; and the printer comprises a printing unit configured to print the first and second print images on a first print body to form a glossy image on the first print body, wherein the first image data includes red, green, and blue data;

the density acquisition unit calculates a luminance value Lu based on Equation (1), and calculates the density value N based on Equation (2) of each pixel, where maxRGB and minRGB are respectively maximum and minimum values among red, green, and blue values of each pixel; and $$LU=[(\text{maxRGB})+(\text{minRGB})]/2 \quad (1)$$

$$N=255-LU \quad (2)$$

the glossy image density decision unit calculates the gloss density value NM based on Equation (3), when the density value N is equal to or greater than Na as the predetermined value, where Dmax is a maximum possible value of the first image data, $$NM=(N-Na)\times[D\text{max}/(D\text{max}-Na)] \quad (3).$$

3. A method of manufacturing a card, comprising:

acquiring a density value of each pixel included in first image data corresponding to a first print image of a first ink, the first ink being a color ink comprising yellow, magenta, and cyan inks;

setting a gloss density value which specifies the density of gloss to be added to the pixel to a minimum possible value of the gloss density value, when the density value of the pixel is less than a predetermined value;

setting the gloss density value to a value larger than the minimum possible value, when the density value of the pixel is equal to or greater than the predetermined value;

performing dithering based on the set gloss density value to create second image data corresponding to a second print image of a glossy ink, the second ink being metal ink containing metal flakes for providing the first print image with metal glossy color; and printing the first and second print images on a card to manufacture a card with a glossy image printed thereon, wherein the printing the first and second print images on a card to manufacture a card with a glossy image printed thereon comprises:

transferring the first and second print images on an intermediate transfer film in this order to superimpose the second print image on the first print image; and retransferring the first and second print images transferred on the intermediate transfer film to the card, to form retransferred images in which the second print image is located on the card side and the first print image is laid on the second print image.

4. The printer according to claim 1, wherein the first ink is a sublimation ink, and the second ink is a fusion ink.

5. The printer according to claim 1, wherein the minimum possible value is zero.

6. The printer according to claim 1, wherein the printing unit prints the first and second print images on the first print body in this order to superimpose the second print image on the first print image.

7. A printer comprising:

an input unit configured to receive first image data corresponding to a first print image of a first ink, the first ink being a color ink comprising yellow, magenta, and cyan inks;

a density acquisition unit configured to acquire a density value of each pixel included in the first image data;

a glossy image density decision unit configured to set a gloss density value which specifies the density of gloss to be added to the pixel to a minimum possible value of the gloss density value, when the density value of the pixel is less than a predetermined value, and sets the gloss density value to a value larger than the minimum possible value, when the density value of the pixel is equal to or greater than the predetermined value;

a dithering processor configured to perform dithering based on the set gloss density value to create second image data corresponding to a second print image of a second ink, the second ink being metal ink containing metal flakes for providing the first print image with a metal glossy color; and a printing unit configured to print the first and second print images on a first print body to form a glossy image on the first print body, wherein the printing unit prints the first and second print images on the first print body in this order to superimpose the second print image on the first print image, and wherein the printing unit comprises a retransfer device configured to retransfer the first and second print images printed on the first print body to a second print body, to form retransferred images in which the second print image is located on the second print body side and the first print image is laid on the second print image.

8. The printing system according to claim 2, wherein the first ink is a sublimation ink, and the second ink is a fusion ink.

9. The printing system according to claim 2, wherein the minimum possible value is zero.

10. The printing system according to claim 2, wherein the printing unit prints the first and second print images on the first print body in this order to superimpose the second print image on the first print image.

11. A printing system comprising:

a printer; and a printer driver configured to send image data to the printer, wherein the printer driver comprises:

an input unit configured to receive first image data corresponding to a first print image of a first ink, the first ink being a color ink comprising yellow, magenta, and cyan inks;

a density acquisition unit configured to acquire a density value of each pixel included in the first image data;

a glossy image density decision unit configured to set a gloss density value which specifies the density of gloss to be added to the pixel to a minimum possible value of the gloss density value, when the density value of the pixel is less than a predetermined value, and to set the gloss density value to a value larger than the minimum possible value, when the density value of the pixel is equal to or greater than the predetermined value; and a dithering processor configured to perform dithering based on the set gloss density value to create second image data corresponding to a second print image of a second ink, the second ink being metal ink containing metal flakes for providing the first print image with metal glossy color;

wherein the printer comprises a printing unit configured to print the first and second print images on a first print body to form a glossy image on the first print body, wherein the printing unit prints the first and second print images on the first print body in this order to superimpose the second print image on the first print image, and wherein the printing unit comprises a retransfer device configured to retransfer the first and second print images printed on the first print body to a second print body, to form retransferred images in which the second print image is located on the second print body side and the first print image is laid on the second print image.

* * * * *